US011377775B2

(12) United States Patent
Jang et al.

(10) Patent No.: US 11,377,775 B2
(45) Date of Patent: Jul. 5, 2022

(54) WASHING MACHINE

(71) Applicant: LG Electronics Inc., Seoul (KR)

(72) Inventors: Hosung Jang, Seoul (KR); Sunghoon Kim, Seoul (KR); Hwanchan Ryu, Seoul (KR)

(73) Assignee: LG Electronics Inc., Seoul (KR)

( * ) Notice: Subject to any disclaimer, the term of this patent is extended or adjusted under 35 U.S.C. 154(b) by 68 days.

(21) Appl. No.: 16/454,990

(22) Filed: Jun. 27, 2019

(65) Prior Publication Data

US 2020/0002877 A1 Jan. 2, 2020

(30) Foreign Application Priority Data

Jun. 27, 2018 (KR) ..... 10-2018-0074382
Jun. 18, 2019 (KR) ..... 10-2019-0072390

(51) Int. Cl.
*D06F 39/08* (2006.01)
*D06F 37/26* (2006.01)
(Continued)

(52) U.S. Cl.
CPC ..... *D06F 39/083* (2013.01); *D06F 37/265* (2013.01); *D06F 37/266* (2013.01);
(Continued)

(58) Field of Classification Search
CPC .... D06F 37/266; D06F 39/083; D06F 39/085; D06F 39/088
See application file for complete search history.

(56) References Cited

U.S. PATENT DOCUMENTS

2008/0276659 A1* 11/2008 Bae ..... D06F 39/008 68/5 C
2011/0088172 A1* 4/2011 Im ..... D06F 21/00 8/137
(Continued)

FOREIGN PATENT DOCUMENTS

CN 2372345 4/2000
CN 101338510 1/2009
(Continued)

OTHER PUBLICATIONS

Extended European Search Report in European Application No. 19182789.8 dated Nov. 26, 2019, 7 pages.
(Continued)

*Primary Examiner* — Spencer E. Bell
(74) *Attorney, Agent, or Firm* — Fish & Richardson P.C.

(57) ABSTRACT

Disclosed is a washing machine including: a plurality of nozzles provided in an inner circumferential surface of a gasket body to spray water into a drum; a pump configured to pump water discharged from a tub; a distribution pipe supplying the water, pumped by the pump, to the plurality of nozzles; and a circulation pipe connecting the distribution pipe and the pump, wherein the pump is disposed in one side of left and right sides with reference to the inlet port, wherein the circulation pipe is bent at least once, wherein the inlet port includes a first positioning protrusion protruding from an outer circumferential surface of an inlet pipe coupled to the circulation pipe, and wherein a first positioning groove allowing the first positioning protrusion to be inserted thereinto is formed at one end of the circulation pipe, and accordingly, misassembling of the circulation pipe may be prevented.

23 Claims, 16 Drawing Sheets

(51) Int. Cl.
*D06F 37/22* (2006.01)
*D06F 39/04* (2006.01)

(52) U.S. Cl.
CPC ..... *D06F 37/22* (2013.01); *D06F 39/04* (2013.01); *D06F 39/085* (2013.01)

(56) References Cited

U.S. PATENT DOCUMENTS

| | | | | |
|---|---|---|---|---|
| 2014/0157956 | A1* | 6/2014 | Date | F04B 53/003 74/99 R |
| 2014/0326025 | A1* | 11/2014 | Im | D06F 39/087 68/139 |
| 2015/0191861 | A1* | 7/2015 | Alessandrini | D06F 39/085 68/207 |
| 2017/0067200 | A1* | 3/2017 | Kim | D06F 37/26 |

FOREIGN PATENT DOCUMENTS

| | | |
|---|---|---|
| CN | 102597354 | 7/2012 |
| CN | 103797180 | 5/2014 |
| CN | 104455839 | 3/2015 |
| CN | 206608659 | 11/2017 |
| CN | 207178943 | 4/2018 |
| EP | 1167856 | 1/2002 |
| EP | 2589697 | 5/2013 |
| EP | 3483329 | 5/2019 |
| JP | 2011250920 | 12/2011 |

OTHER PUBLICATIONS

CN Office Action in Chinese Appln. No. 201910567095.8, dated Feb. 2, 2021, 24 pages (with English translation).
Office Action in Chinese Appln. No. 201910567095.8, dated Sep. 3, 2021, 21 pages (with English translation).

* cited by examiner

WASHING MACHINE

CROSS-REFERENCE TO RELATED APPLICATIONS

This application claims the priority benefit of Korean Application No. 10-2019-0072390, filed on Jun. 18, 2019, and Korean Application No. 10-2018-0074382, filed on Jun. 27, 2018. The disclosures of the prior applications are incorporated by reference in their entirety.

BACKGROUND OF THE INVENTION

1. Field of the Invention

The present invention relates to a washing machine and particularly to a washing machine having nozzles that spray water, discharged from a tub and circulated along a circulation pipe, into a drum.

2. Description of the Related Art

In general, a washing machine is an apparatus for removing a contaminant adhered to clothes, bedding, etc. (hereinafter, referred to as 'the laundry') using a chemical disintegration of water and a detergent and a physical operation such as a friction between water and the laundry. The washing machine includes a tub containing water, and a drum rotatably provided in the tub to accommodate laundry.

Korean Patent Application Publication No. 10-2011-0040180 (hereinafter, referred to as a "related art") discloses a washing machine that circulates water, discharged from a tub, using a circulation pump and sprays the circulated water into a drum through a spray nozzle. The washing machine is in a structure in which a distributer is coupled to the circulation pump to distribute wash water and first and second spray paths are connected to the distributer to guide the wash water to first and second spray nozzles, respectively. In addition, the spray nozzles are connected to a gasket by connectors passing through the gasket and are connected to the spray paths.

The related art discloses a washing machine having two spray nozzles, but the washing machine is not capable of uniformly wetting laundry since spray directions are limited. In particular, although various new technologies for controlling rotation of the drum have been developed to provide diversity to movement of laundry loaded in the drum, it is hard to expect remarkable improvement in performance using the conventional structure.

In addition, the conventional technology has a complex structure because the spray nozzles need to be coupled to the gasket by passing the connectors through the gasket, the spray nozzles connected to the circulation pump need to be in number corresponding to the number of spray nozzles, and a plurality of flow paths and the plurality connectors need to be coupled, respectively. In addition, the manufacturing procedure is bothersome due to the assembling process.

In addition, there are many portions for connecting the pump, the spray paths, the connectors, and the spray nozzles, and wash water is likely to leak through the portions. In addition, there is also a hygiene issue because of solidification of detergent in the wash water or pigmentation of a contaminant.

In order to solve the problem, efforts are being made to develop a technology for guiding circulating water, discharged from a circulation pipe, to a plurality of nozzles.

However, there is a problem that the circulation pipe connecting the circulation pump and a distribution pipe for supplying wash water to the plurality of nozzles can intervene other structures such as a balancer.

In addition, in order to efficiently utilize a space inside the casing of the washing machine, the pump may be generally disposed on one side of the left and right sides of the washing machine. Accordingly, a circulating water discharging portion of a circulation pump and a circulation water introducing portion of the distribution pipe for supplying circulating water to the plurality of nozzles may not be disposed vertically, and this could misassembling of the circulation pipe that connects the circulation pump and the distribution pipe.

SUMMARY OF THE INVENTION

An object of the present invention is to provide a washing machine having a plurality of nozzles for uniformly spraying water discharged from a tub to thereby uniformly wet laundry, and simplifying a connection structure and an assembling process between a pump and the plurality of nozzles.

Another object of the present invention is to provide a washing machine allowing a distribution pipe for supplying was water to a plurality of nozzles and a circulation pipe connecting the same to be placed at the right position Yet another object of the present invention is to provide a washing machine that prevents the circulation pipe from moving out of the right position due to vibration of a tub.

Yet another object of the present invention is to provide a washing machine capable of avoiding intervention of the distribution pipe and the circulation pipe with other structures, such as a balancer and a heater.

Objects of the present invention should not be limited to the aforementioned objects and other unmentioned objects will be clearly understood by those skilled in the art from the following description.

In order to achieve the above objects, a washing machine according to an embodiment of the present invention includes a plurality of nozzles spraying water into a drum, a distribution pipe supplying water pumped by a pump to the plurality of nozzles, and a circulation pipe connecting the distribution pipe and the pump.

The washing machine includes a laundry entry hole formed in a front surface of a casing, an opening formed in a front surface of a tub, and a gasket connecting the laundry entry hole and the opening.

The nozzle is provided in an inner circumferential surface of a gasket body defining a passage of the gasket.

The distribution pipe includes an inlet port introducing water pumped by the pump. The inlet port is coupled to the circulation pipe.

The pump is disposed below the tub. The pump is disposed in one side of left and right sides with reference to the inlet port.

The circulation pipe is bent at least once.

The inlet port includes a positioning means that guides the right position of the circulation pipe. The inlet port includes an inlet pipe inserted into the circulation pipe and a first positioning protrusion protruding from the inlet pipe.

The first positioning protrusion protrudes from an outer circumferential surface of the inlet pipe.

A first positioning groove allowing the first positioning protrusion to be inserted thereinto is formed in the circulation pipe. The first positioning groove is formed at one end portion of the circulation pipe, which is coupled to the inlet port.

The first positioning groove is formed in a shape corresponding to the first positioning protrusion.

The pump may include a circulation port guiding water discharged from the tub to the distribution pipe. The circulation pipe may be coupled to the circulation port.

The circulation port may include a tube portion inserted into the circulation pipe, and a second positioning protrusion protruding from an outer circumferential surface of the tube portion.

The second positioning groove allowing the second positioning protrusion to be inserted thereinto may be formed at the other end portion of the circulation pipe, which is coupled to the circulation port. The second positioning protrusion may be formed in a shape corresponding to the second positioning protrusion.

The circulation pipe may include a first port coupling tube, a second port coupling tube, and a connection tube.

The first port coupling tube may include a first coupling portion coupled to the inlet port, and a first coupling tube portion extending downward from the first coupling portion.

The connection tube may be bent from the first coupling tube portion, and extend toward one side in which the pump is disposed.

The second port coupling tube may be connected to the connection tube and coupled to the circulation port. The second port coupling tube may include a second coupling portion allowing the circulation port to be inserted thereinto, and a corrugated tube portion extending from the second coupling portion toward the connection tube. The second port coupling portion may include a bent tube portion bent from the connection tube in a direction parallel to the coupling portion.

The corrugated tube portion may be relatively flexible compared to the first port coupling portion, the connection tube, and the second coupling portion. The corrugated tube portion may connect the bent tube portion and the second coupling portion.

The corrugated tube portion may connect the bent tube portion and the second coupling portion.

The washing machine may further include a balancer disposed on a front surface of the tub. The balancer may include a first balancer and a second balancer respectively disposed on left and right sides of the gasket on the front surface of the tub. A lower end portion of the first balancer and a lower end portion of the second balancer may be spaced apart from each other in a lower side of the gasket The inlet port and the first port coupling tube may be disposed in a space where the lower end portions of the first and second balancers are spaced apart from each other.

The washing machine may include a heater heating water contained in the tub. the heater may be installed below the tub. The heater may be installed at a rear side further than the front surface of the tub.

The lower end portions of the first and second balancers may extend downward from a lower end portion of the front surface of the tub.

At least a portion of the connection tube may be disposed between one of the first and second balancers, which is disposed on the one side where the pump is disposed, and the heater.

The connection tube may include a first connection tube bent from the first coupling tube portion and extending in a direction where the heater is disposed, and a second connection tube bent from the first connection tube and extending toward the one side in which the pump is disposed. The second connection tube may be disposed at a rear side of the one of the first and second balancers. The second connection tube may be disposed at a front side of the tub.

The first connection tube may be bent from the first coupling portion and extending rearward.

The second connection tube may be bent from the first connection tube and extending toward the one side in which the pump is disposed.

The bent tube portion may be bent downward from the second connection tube.

The first port coupling tube and the second port coupling tube may be disposed in parallel. The first port coupling tube and the second port coupling tube may be disposed to be vertical to a virtual plane including the first and second connection tubes.

The circulation pipe may be fixed to the tub. The circulation pipe may be fixed to the tub by a clamp.

The clamp may include a first clamp and a second clamp. The first clamp may fix the first port coupling tube to the front surface of the tub. The second clamp may fix the connection tube to a lower surface of the tub.

The distribution pipe may include: a transport conduit branching water, introduced through the inlet port, to the left and right sides to be guided upward; and a plurality of outlet ports protruding from the transport conduit toward the gasket, and supplying water to the plurality of nozzles. The inlet port may be disposed at a position lower than the plurality of outlet ports. The inlet port may protrude downward from the transport conduit at a position lower than the plurality of outlet ports.

The first positioning protrusion may extend to an upper end of the inlet port.

The first positioning protrusion may be formed in a front side of the outer circumferential surface of the inlet pipe.

The details of other embodiments are included in the following description and the accompanying drawings.

The washing machine of the present invention may have one or more effects, as below.

First, a plurality of nozzles is provided on an inner circumferential surface of a gasket, and a distribution pipe connects the pump and the plurality of nozzles so as to supply water pumped by the pump to the plurality of nozzles, and thus, there is an advantageous effect of simplifying a connection structure and an assembling process between the pump and the plurality of nozzles.

Second, an inlet port of the distribution pipe include a first positioning protrusion, and a first positioning groove allowing the first positioning protrusion to be inserted thereinto is formed in the circulation pipe, and accordingly, it is possible to assemble the circulation pipe at the right position, thereby preventing any defect caused by misassembling, such as braking of the circulation pipe. Alternatively, the circulation pipe includes a second port coupling tube coupled to a circulation port, and the second port coupling tube includes a corrugated tube portion relatively flexible compared to a first port coupling tube, a connection tube, and a second coupling portion, and accordingly, any defect caused by misassembling, such as braking of the circulation pipe, may be prevented even though the circulation pipe moves out of the right position.

Third, as the circulation pipe includes the flexible corrugated tube portion, the circulation pipe may be prevented from moving out of the right position due to vibration of the tub.

Fourth, a first balancer and a second balancer are respectively disposed on the left and right sides with reference to the gasket, the inlet port and the first port coupling tube are disposed in a space at a lower side where the first and second balancers are spaced apart from each other. In addition, at least a portion of the connection tube connecting the first port coupling tube and the second coupling tube is disposed between a heater disposed below the tub and the balancers, and accordingly, the distribution pipe and the circulation pipe may avoid intervention with other structures such as the balancers and the heater.

Effects of the present invention should not be limited to the aforementioned effects and other unmentioned effects will be clearly understood by those skilled in the art from the claims.

BRIEF DESCRIPTION OF THE DRAWINGS

The embodiments will be described in detail with reference to the following drawings in which like reference numerals refer to like elements wherein.

DETAILED DESCRIPTION OF THE PREFERRED EMBODIMENTS

Figure 1:
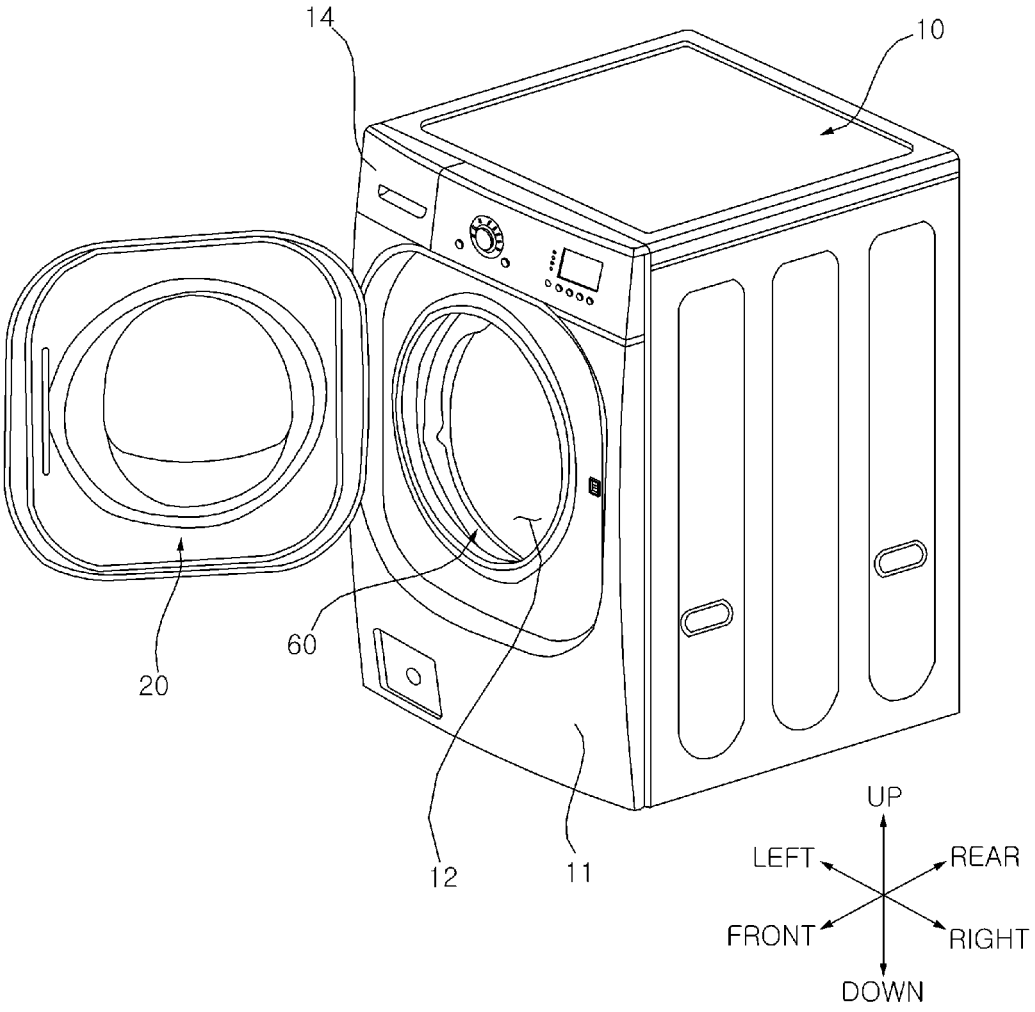
FIG. 1 is a perspective view of a washing machine according to an embodiment of the present invention.

Advantages and features of the present disclosure and methods to achieve them will become apparent from the descriptions of exemplary embodiments herein below with reference to the accompanying drawings. However, the present disclosure is not limited to exemplary embodiments disclosed herein but may be implemented in various different ways. The exemplary embodiments are provided for making the disclosure of the present disclosure thorough and for fully conveying the scope of the present disclosure to those skilled in the art. It is to be noted that the scope of the present disclosure is defined only by the claims. Like reference numerals denote like elements throughout the descriptions.

Hereinafter, the present invention will be described in detail with reference to the accompanying drawings.

Figure 2:
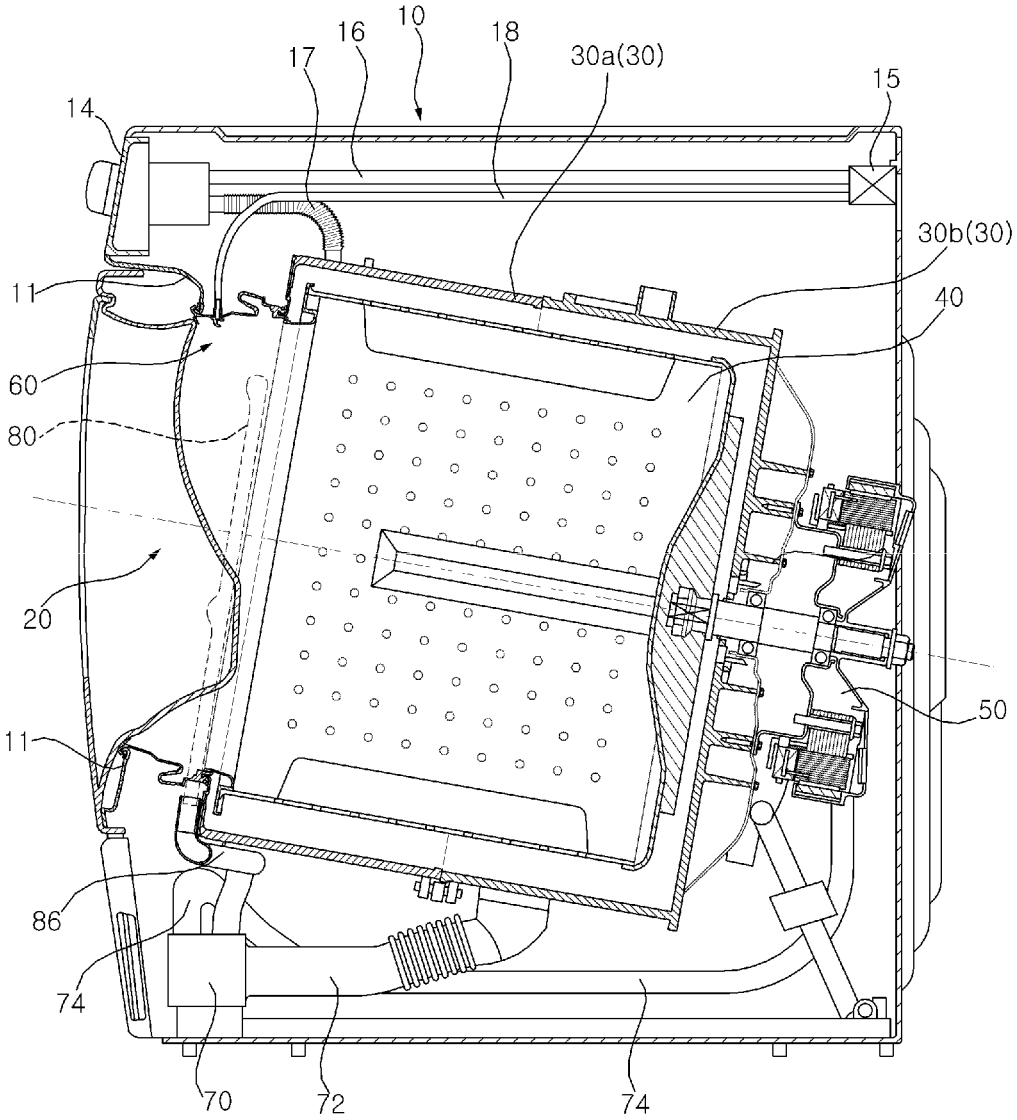
FIG. 2 is a cross-sectional view of the washing machine shown in FIG. 1.

Referring to FIGS. 1 and 2, a washing machine according to the present invention includes a casing 10 forming an exterior appearance of the washing machine, a tub 30 for containing wash water, and a drum 40 rotatably provided in the tub 30 to receive laundry. In addition, the washing machine may include a motor (hereinafter, referred to as a "driving unit") for rotating the drum 40.

A front panel 11 having a laundry entry hole 12 formed therein is disposed on a front surface of the casing 10. A door 20 for opening and closing the laundry entry hole 12 is disposed on the front panel 11, and a dispenser 14 for supplying detergent may be installed on the front panel 11.

In addition, a water supply valve 15, a water supply pipe 16, and a water supply hose 17 are installed in the casing 10 so that wash water supplied after passing through the water supply valve 15 and the water supply pipe 16 is mixed with detergent in the dispenser 14 and is then supplied to the tub 30 through the water supply hose 17.

Meanwhile, a direct water supply pipe 18 may be connected to the water supply valve 15 so that wash water is supplied directly to the tub 30 through the direct water supply pipe 18 without being mixed with detergent.

In addition, a pump 70 and a distribution pipe 80 may be installed. The pump 70 and the tub 30 may be connected via a discharge hose 72, and the distribution pipe 80 and the pump 70 may be connected via a circulation pipe 86. Accordingly, if the pump 70 operates, wash water contained in the tub 30 may be sprayed into the drum 40 through the distribution pipe 80 and circulate. The pump 70 may be connected to a drain pipe 74 and discharge wash water to the outside through the drain pipe 74.

As described above, the pump 70 of the washing machine according to an embodiment of the present invention functions a drain pump for discharging wash water to the outside and as a circulation pump for circulating wash water. On the contrary, a drain pump and a circulation pump may be installed individually, and, in this case, it is obvious that the drain pump is connected to the drain pipe 74 and the circulation pump is connected to the circulation pipe 86.

Meanwhile, the tub 30 may be formed as a single tub body or may be formed as a combination of a first tub body 30*a* and a second tub body 30*b* coupled thereto. In the embodiment of the present invention, an example in which the first tub body 30*a* and the second tub body 30*b* are coupled to form the tub 30 is described. Hereinafter, the first tub body 30*a* is referred to as a "tub" 30.

The tub 30 is disposed in the casing 10, and an opening 32 (see FIG. 4) is formed at the front of the tub 30 to correspond to the laundry entry hole 12 formed in the front panel 11.

The drum 40 for receiving laundry may be rotatably provided in the tub 30. The drum 40 receives laundry, and is disposed such that an entrance hole through which laundry is loaded is disposed at a front surface. The drum 40 is rotated about an approximately horizontal rotation center line. In this case, "horizontal" does not refer to the mathematical definition thereof. That is, even in the case where the rotation center line is inclined at a predetermined angle relative to a horizontal state, the axis is more like in the horizontal state than in a vertical state, and thus, it is considered that the rotation center line is substantially horizontal. A plurality of through holes may be formed in the drum 40 so as to introduce water contained in the tub 30 into the drum 40.

A plurality of lifter may be provided on an inner surface of the drum 40. The plurality of liters may be disposed at a predetermined angle relative to the center of the drum 40.

When the drum 40 is rotated, laundry repeatedly goes through an operation of being lifted by the lifter and falling.

A driving unit 50 for rotating the drum 40 may be further provided. A driving shaft to be rotated by the driving unit 50 may penetrate the rear of the tub 30 to be coupled to the drum 40.

Preferably, the driving unit 50 includes a direct drive wash motor, and the wash motor may include a stator fixed to a rear side of the tub 30, and a rotor rotating by a magnetic force acting in relation with the stator. The driving shaft 38*a* may rotate integrally with the rotor.

Figure 3:
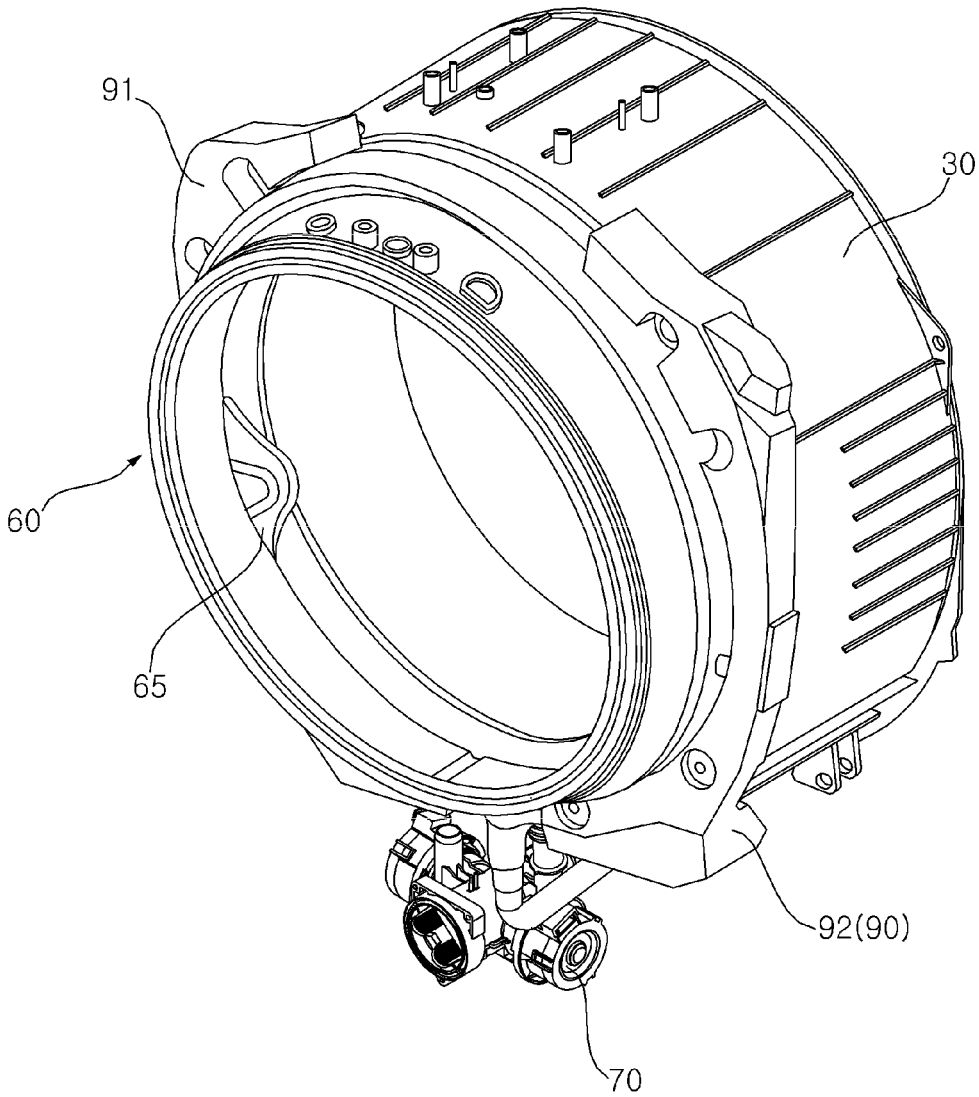
FIG. 3 illustrates a portion of the washing machine shown in FIG. 2.
Figure 4:
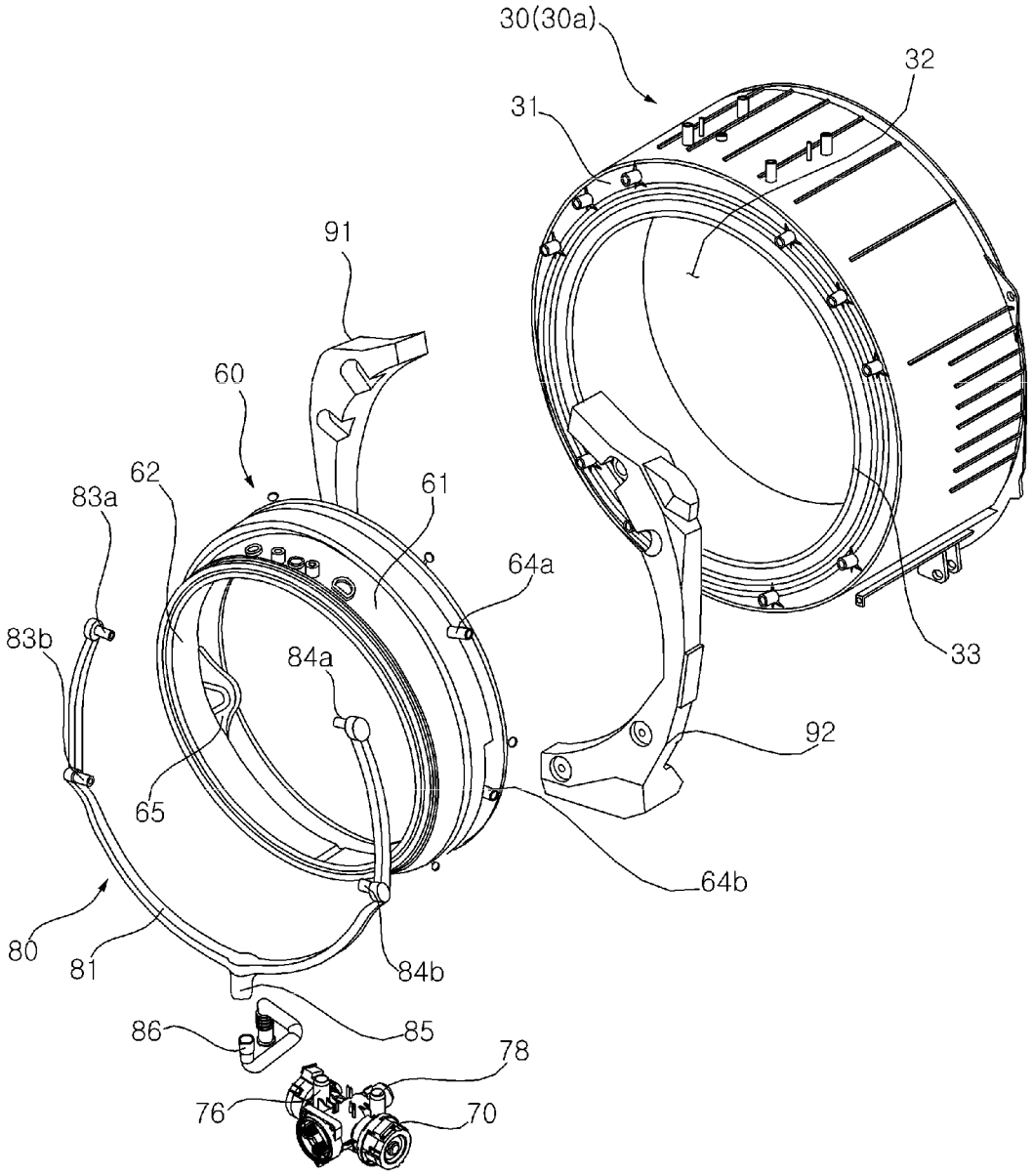
FIG. 4 is an exploded perspective view of an assembly shown in FIG. 3.

Referring to FIGS. 3 and 4, the washing machine according to an embodiment of the present invention includes a gasket 60 for connecting the casing 10 and the tub 30, a nozzle 66 and 67 (see FIG. 6) for spraying water into the drum 40, the pump 70 for pumping water discharged from the tub 30, and a distribution pipe 80 for guiding the water pumped by the pump 70 to the nozzle 66 and 67, and the circulation pipe 86 for guiding the water pumped by the pump 70 to the distribution pipe 80. In addition, the washing machine may include a balancer 90 disposed at the front surface 31 of the tub 30, and a heater 95 installed below the tub 30.

Referring to FIGS. 3, 4, 5, and 9, the gasket 60 includes a gasket body 61 and 62 that forms a passage 60P connecting the laundry entry hole 12 of the casing 10 and the opening 32 of the tub 30. An inner circumferential surface facing the central direction of the gasket body 61 and 62 of the gasket 60 may be referred to as an inner circumferential surface 62, and an outer circumferential surface opposite thereto may be referred to the inner circumferential surface 61. Hereinafter, the outer circumferential surface 61 and the inner circumferential surface 62 of the gasket body 61 and 62 are respectively referred to as an outer circumferential surface 61 and an inner circumferential surface 62 of the gasket 60.

The inner circumferential surface 62 of the gasket 60 may form the passage 60P connecting the laundry entry hole 12 and the opening 32. The outer circumferential surface 61 of the gasket 60 may oppose the inner circumferential surface of the balancer 90. The outer circumferential surface of the gasket 60 may oppose the distribution pipe 80.

The gasket 60 is disposed between an edge defining the entry hole 12 of the front panel 11 and an edge defining the opening 32 of the tub 30, and accordingly, a leakage of wash water contained in the tub 30 is prevented.

More specifically, the gasket 60 is formed of a flexible substance such as rubber and has an approximate cylindrical shape (hereinafter, referred to as an annular shape). For example, the gasket 60 may be formed of a substance such as Ethylene Propylene Diene Monomer (EPDM), Thermo Plastic Elastomer (TPE), or the like, but aspects of the present invention are not limited thereto.

As the boundary of the front side of the gasket 60 is connected to the edge of the entry hole 12 of the front panel 11 and the boundary of the rear side of the gasket 60 is connected to the edge of the opening 32 of the tub 30, the body part 61 and 62 connecting the boundaries of the front and rear sides of the gasket 60 forms the laundry entry passage 60P. If a space between the tub and the front panel are sealed and the door 20 is closed, the door 20 and the front end of the gasket 60 are tightly brought into contact with each other and the space between the door 20 and the gasket 60 is sealed, and therefore, leakage of wash water is prevented.

A front end and a rear end of the gasket 60 are annular, and the gasket 60 has a tubular shape extending from the front end to the rear end. The front end of the gasket 60 is fixed to the casing 10, and the rear end is fixed to an entrance hole circumference 33 of the tub 30. The gasket 60 may be formed of a flexible or elastic substance. The gasket 60 may be formed of natural rubber or synthetic resin.

The gasket 60 may include a casing coupling part 68*a* coupled to a circumference of the entry hole 12 of the casing 10, a tub coupling part 68*b* coupled to a circumference of the entrance hole circumference 33 of the tub 30, and a body part 61 and 62 extending between the casing coupling part 68*a* and the tub coupling part 68*b*.

The casing coupling part 68*a* and the tub coupling part 68*b* have an annular shape. The gasket body may include an annular front end connected to the casing coupling part 68*a* and an annular rear end connected to the tub coupling part 68*b*, and have a tubular shape extending from the front end to the rear end.

The circumference of the entry hole 12 of the front panel 11 is rolled outwardly, and the casing coupling part 68 may be fitted into a concave area formed by the outward rolled portion.

An annular groove to be wound by a wire may be formed in the casing coupling part 61. After the wire winds around the groove 61*r*, both ends of the wire are bound, and therefore, the casing coupling part 61 is tightly fixed to the circumference of the entrance hole 12*h*.

The entrance hole circumference 33 of the tub 30, which defines the opening 32 of the tub 30, protrudes from the front surface 31 and is rolled outward, and the tub coupling part 68*b* is fitted in a concave area formed by the outward rolled portion. An annular groove to be wound by a clamp, which is formed of a wire, may be formed in the tub coupling part 68*b*. The tub coupling part 68*b* of the gasket is coupled to the entrance opening circumference 33 of the tub, the clamp winds around the groove, and both ends of the clamp are bounded, and accordingly, the tub coupling part 68*b* may be tightly fixed to the entrance hole circumference 33 of the tub 30.

While the casing coupling part 68*a* is fixed to the front panel 11, the tub coupling part 68*b* is displaceable in accordance with movement of the tub 30. Accordingly, the gasket body needs to be able to transform in accordance with the displacement of the tub coupling part 68*b*. In order to allow the gasket body to transform easily, the gasket 60 may include a folding part 61*b* between the casing coupling part 68*a* and the tub coupling part 68*b* (or the body part), and the folding part 61*b* is folded as the tub 30 moves in a direction of eccentricity (or a radial direction).

Figure 6:
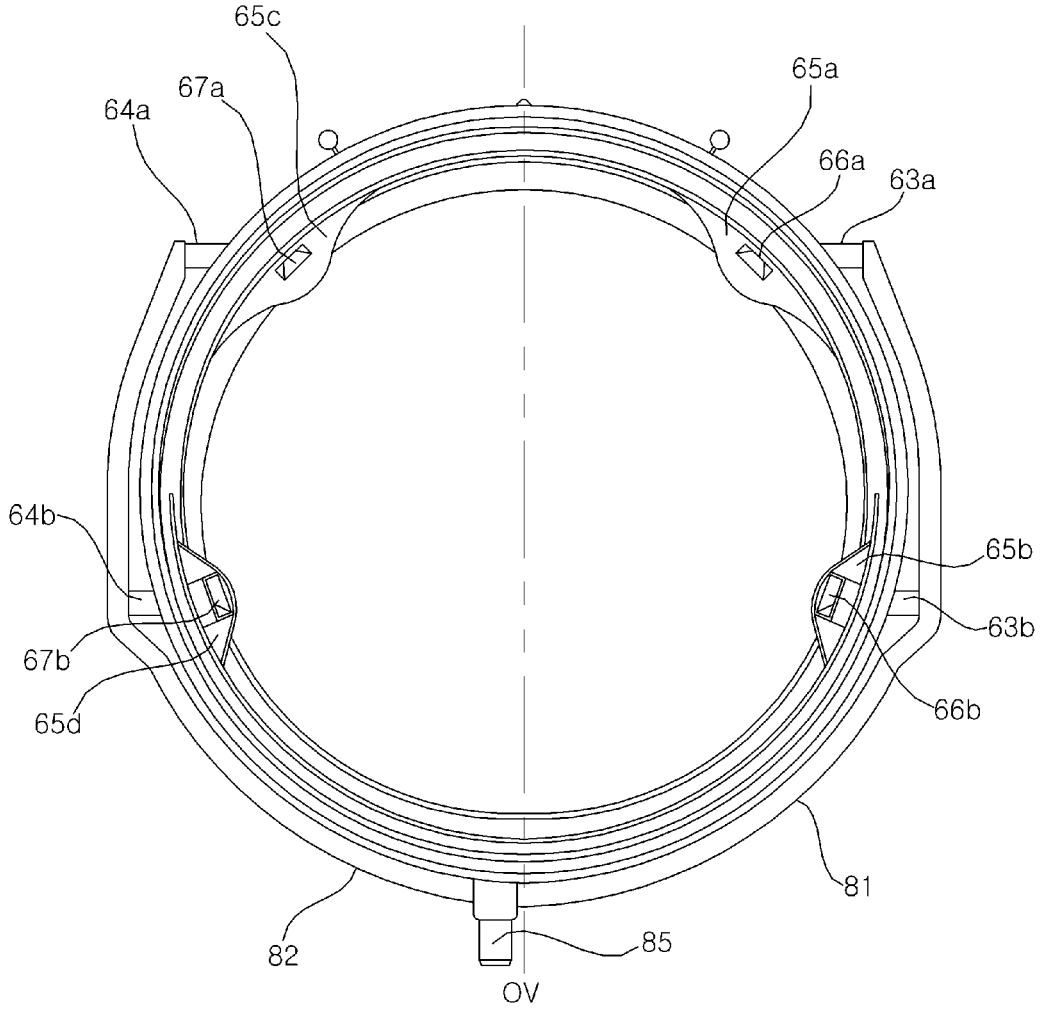
FIG. 6 is a rear view of an assembly including the gasket and a distribution pipe shown in FIG. 4.
Figure 7:
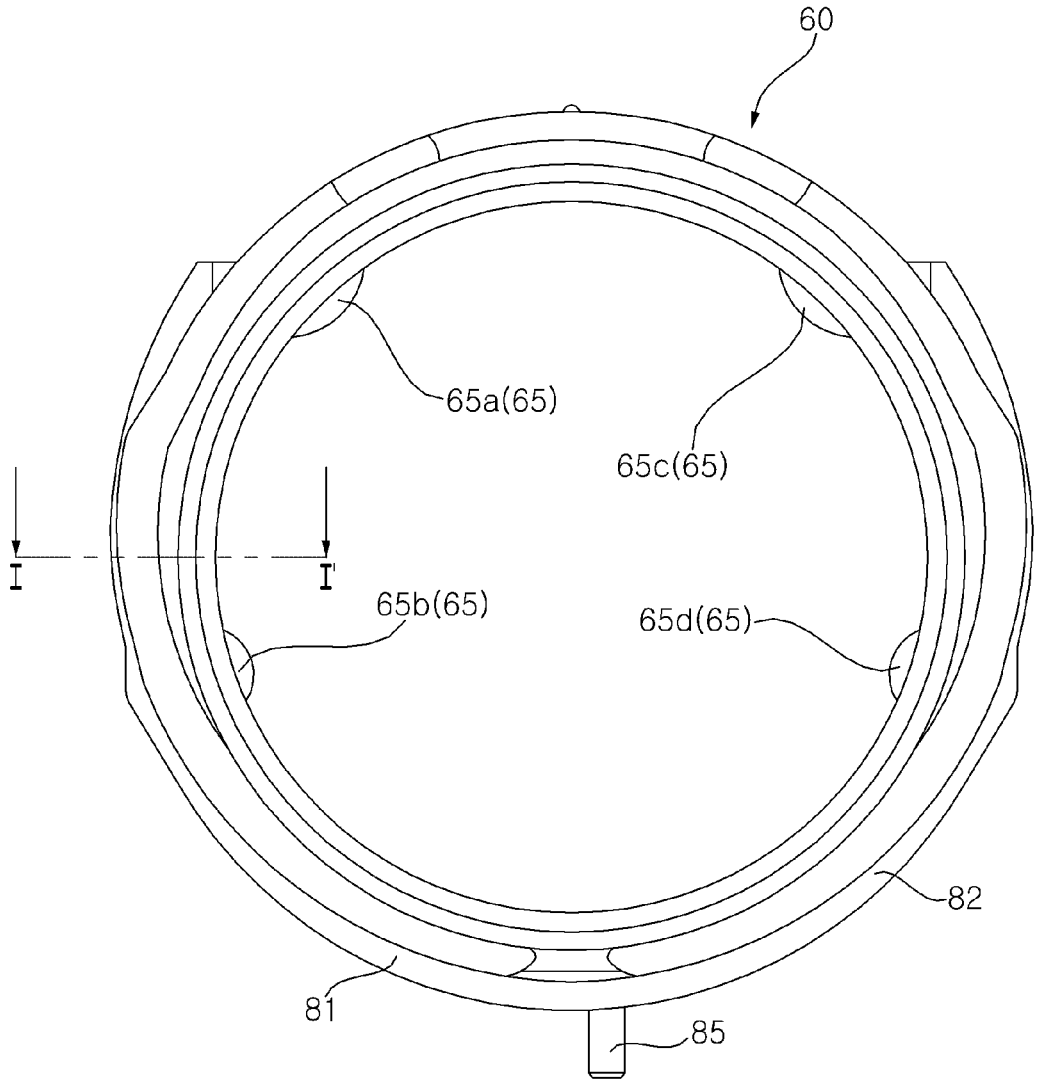
FIG. 7 is a front view of the assembly shown in FIG. 6.

Referring to FIGS. 6 and 7, the nozzle 66 and 67 may be provided in plural on the inner circumferential surface 62 of the gasket 60. The nozzle 66 and 67 may include an upper nozzle 66*a* and 67*a*, and a lower nozzle 66*b* and 67*b* disposed lower than the upper nozzle 66*a* and 67*a*. The upper nozzle 66*a* and 67*a* may be disposed higher than the center of the gasket 60, and the lower nozzle 66*b* and 67*b* may be disposed lower than the center of the gasket 60.

A plurality of nozzles 66 and 67 may include a first nozzle 66 and a second nozzle 67 respectively disposed on the left and right sides of the inner circumferential surface 62 of the gasket. The first nozzle 66 may be disposed on the left side of the inner circumferential surface 62 of the gasket, and the second nozzle 67 may be disposed on the right side of the inner circumferential surface 62 of the gasket.

Each of the first nozzle 66 and the second nozzle 67 may be provided in plural. In the embodiment of the present invention, two first nozzles 66 and two second nozzles 67 are provided, but aspects of the present invention are not limited thereto.

The first nozzle 66 may include a first lower nozzle 66*b* disposed lower than the center of the gasket 60, and a first upper nozzle disposed higher than the first lower nozzle 66*b*. The first upper nozzle 66*a* may be disposed higher than the center of the gasket 60.

The second nozzle 67 may include a second lower nozzle 67*b* disposed lower than the center of the gasket 60, and a second upper nozzle 67*a* may be disposed higher than the second lower nozzle 67*b*. The second upper nozzle 67*a* may be disposed higher than the center of the gasket 60.

The first and second lower nozzles 66*b* and 67*b* may spray circulating water into the drum 40 in an upward direction. The first and second upper nozzles 66*a* and 67*a* may spray circulating water into the drum 40 in a downward direction. The circulating water refers to water that is discharged from the tub 30, pumped by the pump 70, guided to the distribution pipe 80, and sprayed into the drum 40 through the nozzle 66 and 67.

In the gasket 60, there may be provided a direct nozzle for spraying water into the drum 40, and a direct water supply pipe 18 for guiding water supplied through a water supply unit to the direct nozzle. The direct nozzle may be a whirl nozzle or a spray nozzle, but aspects of the present invention are not necessarily limited thereto. When viewed from the front, the direct nozzle may be disposed on a vertical line OV. A window 22 may protrude toward the drum 40 further than the direct nozzle. A water stream sprayed through the direct nozzle may touch the window 22, and, in this case, the effect of cleaning the window 22 may be achieved.

Figure 5:
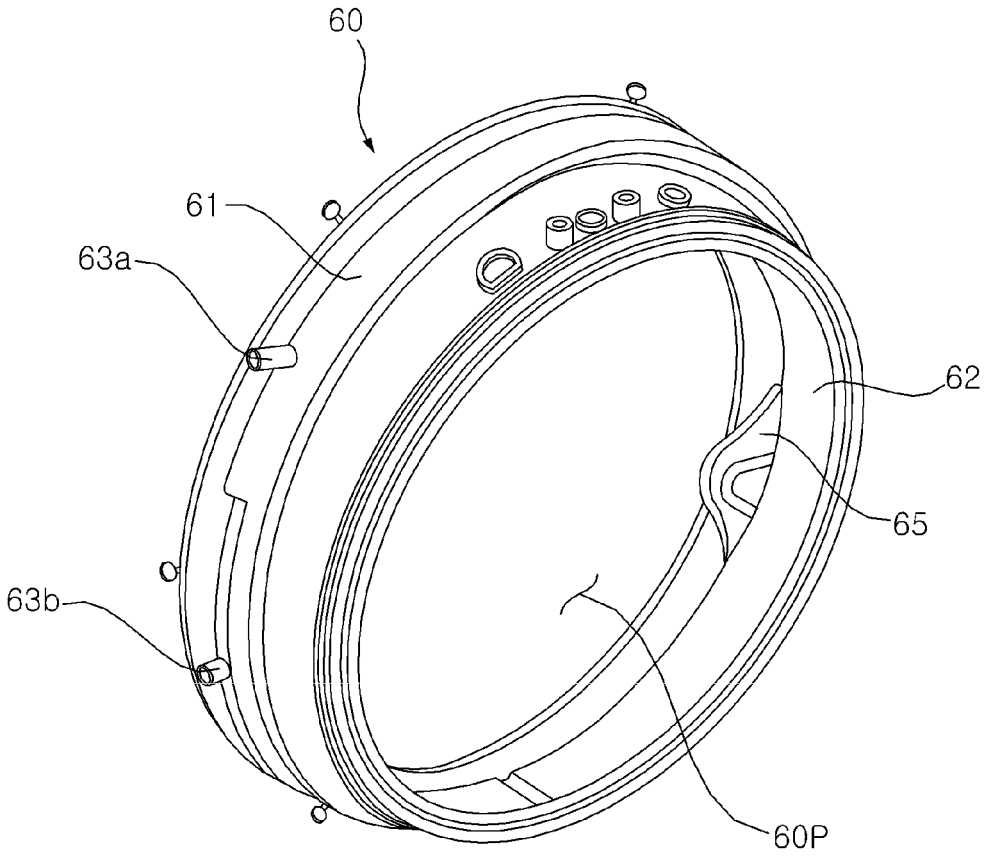
FIG. 5 is a perspective view of a gasket shown in FIG. 4.

Referring to FIGS. 5 and 6, the gasket 60 includes a port receiving pipe 63 and 64 having a hole formed therein to communicate with the nozzle 66 and 67. The port receiving pipe 63 and 64 may be formed to protrude from the outer circumferential surface 61 of the gasket 60. An outlet ports 83 and 84 described in the following are inserted into the port receiving pipe 63 and 64, and the port receiving pipe 63 and 64 are formed to protrude from the outer circumferential surface 61 of the gasket 60, and accordingly, it is possible to prevent that water supplied from the distribution pipe 80 to the nozzles 66 and 67 leaks through between the port receiving pipe 62 and 63 and the outlet port 83 and 84.

The port receiving pipe 63 and 64 may be provided in plural, as does the above-described nozzles 66 and 67. A plurality of port receiving pipes 63 and 64 may provide in number corresponding to the number of nozzles 66 and 67. The port receiving pipe 63 and 64 include a first port receiving pipe 63 disposed on the left side of the outer circumferential surface 61 of the gasket, and a second port receiving pipe 64 disposed on the right side of the outer circumferential surface 61 of the gasket.

The first port receiving pipe 63 may include a first lower port receiving pipe 63*b* disposed lower than the center of the gasket 60, and a first upper port receiving pipe 63*a* disposed higher than the first lower port receiving pipe 63*b*. The first upper port receiving pipe 63*a* may be disposed higher than the center of the gasket 60. The first lower port receiving pipe 63*b* communicates with the first lower nozzle 66*b*, and the first upper port receiving pipe 63*a* communicates with the first upper nozzle 66*a*. The first upper port receiving pipe 63*a* and the first lower port receiving pipe 63*b* may protrude in directions parallel with each other.

The second port receiving pipe 64 may include a second lower port receiving pipe 64*b* disposed lower than the center of the gasket 60, and a second upper port receiving pipe 64*a* disposed higher than the second lower port receiving pipe 6*b*. The second upper port receiving pipe 64*a* may be disposed higher than the center of the gasket 60. The second lower port receiving pipe 64*b* communicates with the second lower nozzle 67*b*, and the second upper port receiving pipe 64*a* communicates with the second upper nozzle 67*a*. The second upper port receiving pipe 64*a* and the second lower port receiving pipe 64*b* may protrude in directions parallel with each other.

Referring to FIGS. 6 and 7, a protruding part 65 may be formed in the inner circumferential surface 62 of the gasket at a portion corresponding to the port receiving pipe 63 and 64 to protrude inward, and the nozzle 66 may be formed at the protruding part 65.

The protruding part 65 may include a first protruding part 65*a*, a second protruding part 65*b*, a third protruding part 65*c*, and a fourth protruding part 65*d* protruding inwardly at portions that respectively correspond to the first upper and lower port receiving pipes 63*a* and 63*b* and the second upper and lower port receiving pipes 64*a* and 64*b*. The first upper and lower nozzles 66*a* and 66*b* and the second upper and lower nozzles 67*a* and 67*b* may be respectively formed at the first protruding part 65*a*, the second protruding part 65*b*, the third protruding part 65*c*, and the fourth protruding part 65*d*.

Figure 8:
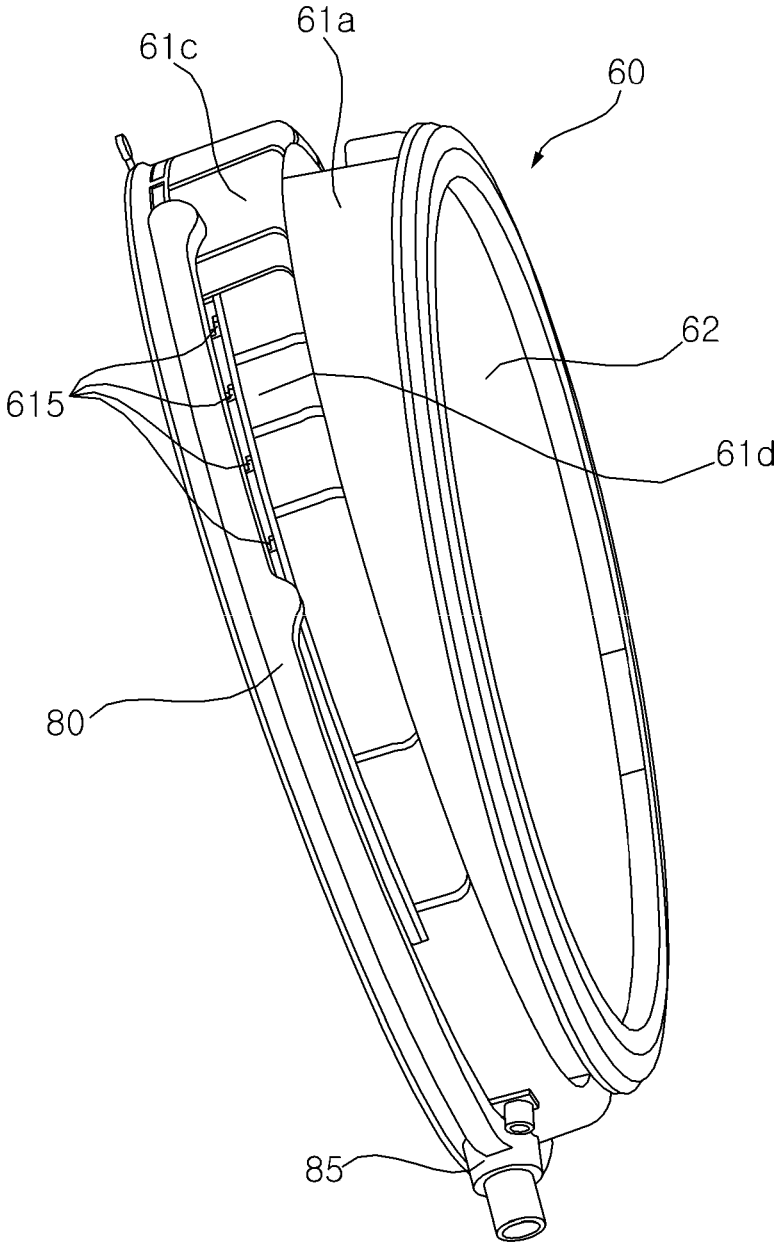
FIG. 8 is a perspective view of the assembly shown in FIG. 6.
Figure 9:
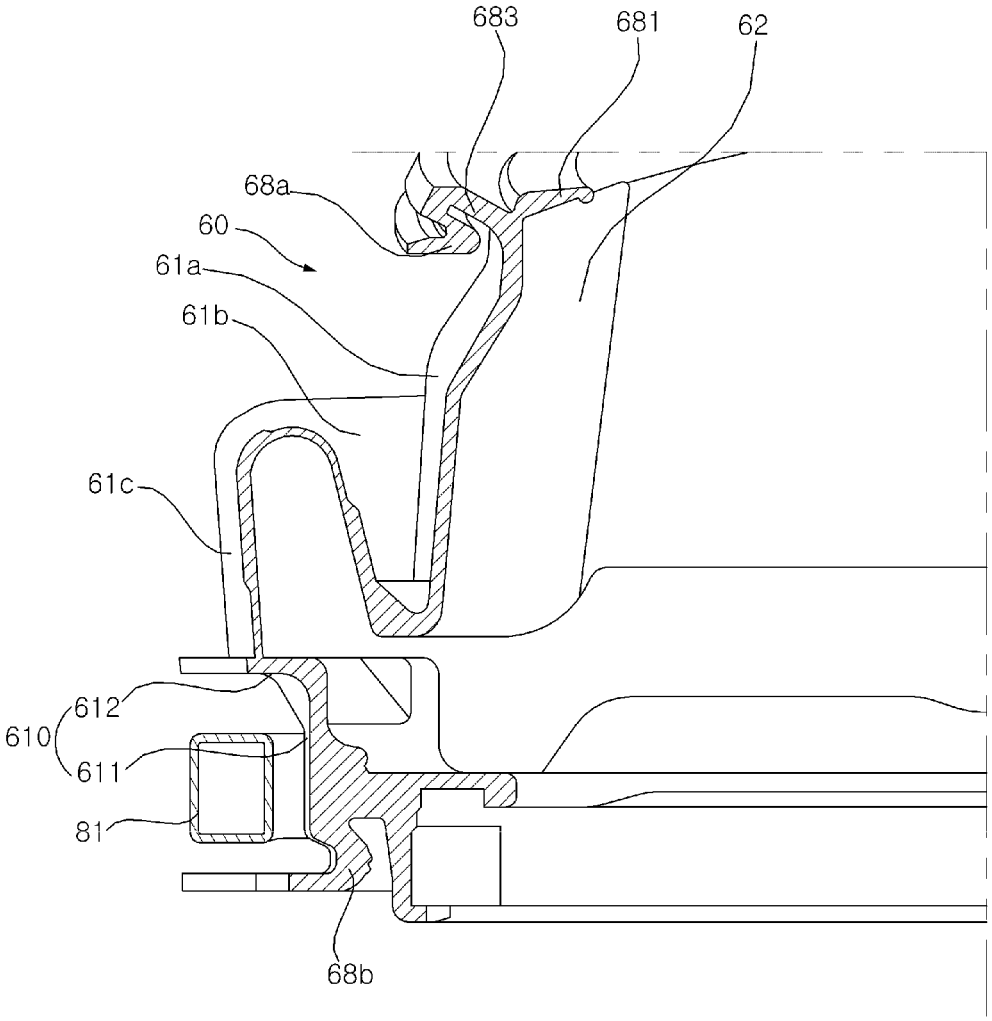
FIG. 9 is a cross-sectional view taken along line I-I in FIG. 7.
Figure 10:
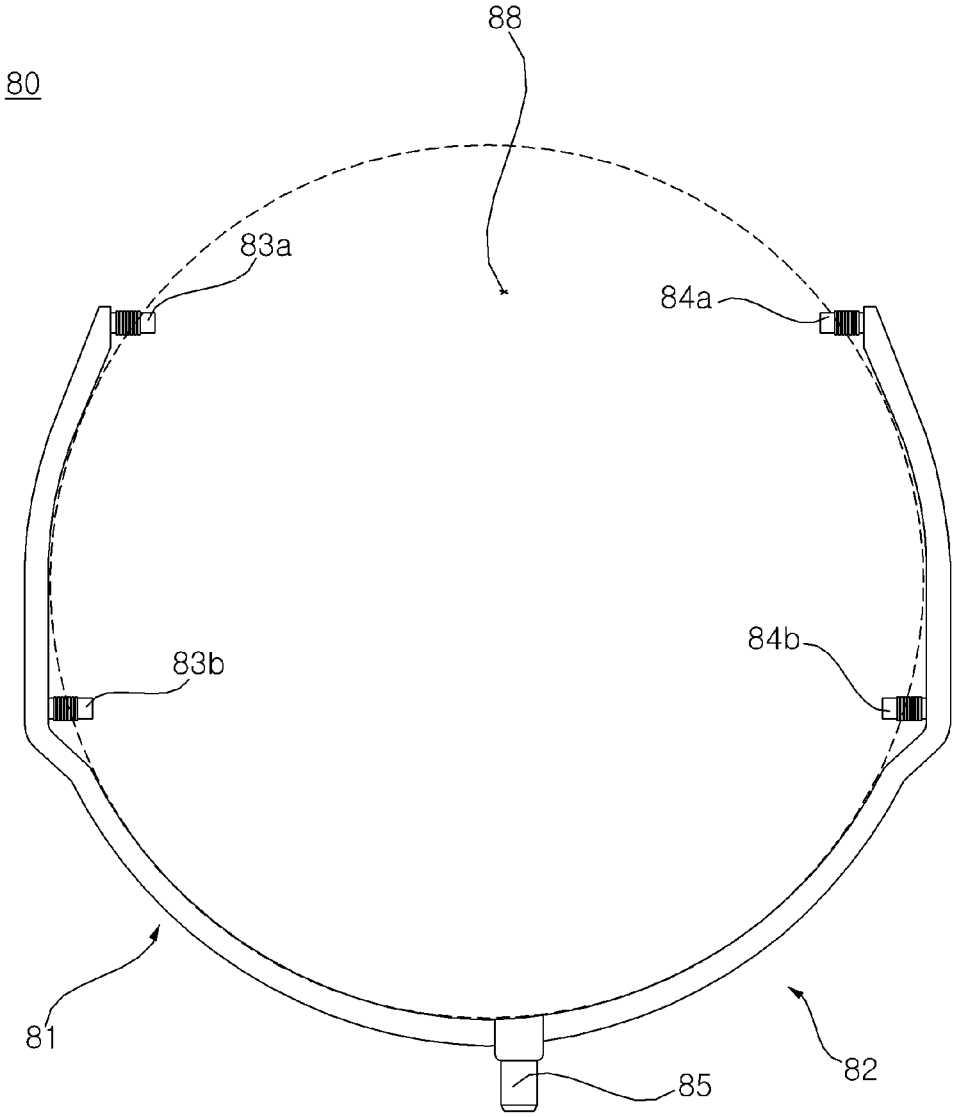
FIG. 10 is a front view of the distribution pipe shown in FIG. 4.

Referring to FIGS. 8 and 9, the gasket 60 includes a recessed portion 610 that is recessed inward further than a portion adjacent to the outer circumferential surface 61. At least a portion of the distribution pipe 80 is disposed in the recessed portion 610. At least a portion of a transport pipe 81 and 82 may be disposed in the recessed portion 610.

The recessed portion 610 is formed to be recessed inward further than a portion adjacent to the front of the recessed portion 610. The recessed portion 610 may be formed as a portion of the outer circumferential surface 61 of the gasket body is recessed inwardly. A riser portion 61*d* protruding outward further than the surrounding area may be formed on the outer circumferential surface 61 of the gasket body, and the recessed portion 610 may be formed on one side (a rear side) of the riser portion 61*d*.

A rib 615 may be formed in the outer circumferential surface 61 of the gasket 60. The rib 615 may protrude from the outer circumferential surface 61 of the gasket 60 in a radial direction of the gasket 60. That is, the rib 615 may extend in a direction that is orthogonal to a tangent line of the outer circumferential surface 61 of the gasket 60.

The distribution pipe 80 may be disposed to allow at least a portion thereof to be brought into contact with the rib 615. At least a portion of the transport conduit 81 and 82 in the distribution pipe 80 may be brought into contact with the rib 615. Since at least a portion of the distribution pipe 80 is disposed in the recessed portion 610, the rib 615 may be formed in the recessed portion 610.

Referring to FIGS. 6 to 10, the distribution pipe 80 includes the transport conduit 81 and 82 for guiding water pumped by the pump 70, and the outlet port 83 and 84 protruding from the transport conduit 81 and 82 toward the gasket 60 and coupled to the port receiving pipe 63 and 64. In addition, the distribution pipe 80 may include an inlet port 85 introducing water discharged from the pump 70, and the transport conduit 82 may guide the water introduced through the inlet port 85 to the port receiving pipes 63 and 64.

The transport conduit 81 and 82 of the distribution pipe 80 is disposed on the outer circumferential surface 61 of the gasket body. The distribution pipe 80 may be inserted into the gasket 60 as the outlet port 83 and 84 are inserted into the port receiving pipes 63 and 64. The transport conduit 81 and 82 of the distribution pipe 80 may be disposed between the outer circumferential surface 61 of the gasket body and the balancer 90. Accordingly, the distribution pipe 80 may be installed without a need for an additional space.

The distribution pipe 80 may be formed of synthetic resin that is harder or stiffer than the gasket 60. The distribution pipe 80 maintains a predetermined shape in spite of vibration occurring during operation of the washing machine, and the distribution pipe 80 is relatively rigid compared to the gasket 60 that transforms in response to vibration of the tub 30.

In addition, the circulation pipe 86 may be flexible to transform in response to vibration of the tub 30. In this case, the distribution pipe 80 may be formed of synthetic resin harder or stiffer than the circulation pipe 86.

The distribution pipe 80 may have an upper side 88 that is in an open ring shape. That is, the distribution pipe 80 may include an inlet port 85 through which water pumped by the pump 70 is introduced, one or more outlet ports 83 and 84 discharging the introduced water to be spayed into the drum 40, and a transport conduit 81 and 82 connecting the inlet ports 85 and the outlet ports 83 and 84. One end of a left conduit 81 of the transport conduit 81 and 82 and one end of a right conduit 82 of the transport conduit 81 and 82 may be connected to each other at a point where the inlet port 85 is disposed, whereas the other end of the left conduit 81 and the other end of the right conduit 82 may be separated from each other.

The inlet port 85 may be formed in a lower side of the transport conduit 81 and 82 to protrude downward, and the outlet port 83 and 84 may be formed at each of the left and right parts of the distribution pipe 80 to protrude inwardly (or toward the gasket). The circulation pipe 86 may be disposed between the inlet port 85 and a circulation port 87 formed in the pump 70, so that wash water in the tub is introduced into the inlet port 85 through the circulation pipe 86.

A plurality of outlet ports 83 and 84 may include an upper outlet port 83*a* and 84*a* coupled to the upper port receiving pipe 63*a* and 64*a* of the gasket 60, and a lower outlet ports 83*b* and 84*b* coupled to the lower port receiving pipe 63*b* and 64*b* of the gasket 60. The upper outlet port 83*a* and 84*a* and the lower outlet port 83*b* and 84*b* may protrude from the transport conduit 81 and 82 toward the gasket body 61 and 62 in directions parallel to each other (which is in other words parallel directions). The upper outlet port 83*a* and 84*a* and the lower outlet port 83*b* and 84*b* may protrude in parallel with a horizontal line passing through the center of the gasket.

The outlet port 83 and 84 protrudes from an inner surface of the transport conduit 81 and 82 (that is, a surface facing the outer circumferential surface 61 of the gasket) toward the center of the gasket 60, and is inserted into the port receiving pipe 62 and 64. The outlet port 83 and 84 may guide circulating water, flowing along the transport conduit 81 and 82, to the nozzle 55 and 67, so that the circulation water is sprayed into the drum 40.

The outlet port 83 and 84 may be formed with a diameter a bit greater than an inner diameter of the port receiving pipe 63 and 64, so that the outlet port 83 and 84 can be press-fitted into the port receiving pipe 63 and 64. When the circulating water flows from the outlet port 83 and 84 toward the nozzle 66 and 67, a reaction force in a direction against the gasket 60 may be applied to a section where the outlet port 83 and 84 is disposed in the transport conduit 81 and 82. In order to prevent separation of the distribution pipe 80 from the gasket 60 by the reaction force, the port receiving pipe 63 and 64 may be formed to protrude outward from the outer circumferential surface 61 of the gasket, and the outlet port 83 and 84 may be formed with a diameter a bit greater than the inner diameter of the port receiving pipe 63 and 64.

The outlet port 83 and 84 includes a first outlet port 83 protruding from the left conduit part 81 of the transport conduit 81 and 82 toward a vertical line OV passing through the center of the gasket 60, and a second outlet port 84 protruding from the right conduit part 82 of the transport conduit 81 and 82 toward the vertical line OV passing through the center of the gasket 60. The first outlet port 83 is inserted into the first port receiving pipe 63 to guide circulating water to the first nozzle 66, and the second outlet port 84 is inserted into the second port receiving pipe 64 to guide circulating water to the second nozzle 67.

The first outlet port 83 may include a first lower outlet port 83*b* inserted into the first lower port receiving pipe 63*b*, and a first upper outlet port 83*a* disposed higher than the first lower outlet port 83*b* and inserted into the first upper port receiving pipe 63*a*. The second outlet port 84 may include a second lower outlet port 84*b* inserted into the second lower port receiving pipe 64*b*, and a second upper outlet port 84*a* disposed higher than the second lower outlet port 84*b* and inserted into the second upper port receiving pipe 64*a*.

The inlet port 85 may be connected to the transport conduit 81 and 82 at a position lower than any of the plurality of outlet ports 83 and 84. The inlet port 85 is connected to the transport conduit 81 and 82 at a position lower than the lower outlet ports 83 and 84.

The transport conduit 81 and 82 may include a first conduit part 81 forming the left side of the transport conduit 81 and 82 with reference to the inlet port 85, and a second conduit part 82 forming the right side of the transport conduit 81 and 82 with reference to the inlet port 85. The first conduit part 81 and the second conduit part 82 may be connected to each other at a lower side, and the inlet port 85 may protrude downward from a point where the first and second conduit parts are connected to each other.

The transport conduit 81 and 82 may be formed in an arc shape of which the central angle is equal to or greater than 180°, and which has an open top side. The transport conduit 81 and 81 may be bilaterally symmetrical. The transport conduit 81 and 82 may include the first conduit part 81 disposed on the left side and the second conduit part 82 disposed on the right side. The first conduit part 81 and the second conduit part 82 may be bilaterally symmetrical about the vertical line OV passing through the center of the gasket 60.

The transport conduit 81 and 82 may branch water, introduced through the inlet port 85, to the left and right sides to guide upwardly. By branching the circulating water introduced through the inlet port, the transport conduit 81 and 82 may form a first sub-flow (water flowing along the first conduit part 81) and a second sub-flow (water flowing along the second conduit part 82). The first sub-flow may be sprayed into the drum 40 through the first nozzle 66, and the second sub-flow may be sprayed into the drum 40 through the second nozzle 67.

The transport conduit 81 and 82 may be disposed between the gasket 60 and the balancer 90. The transport conduit 81 and 82 may be disposed in a manner in which the inner surface of the transport conduit 81 and 82 opposes the gasket 60 and the outer surface of the transport conduit 81 and 82 opposes the balancer 90.

The port receiving pipe 63 and 64, the protruding part 65, the nozzle 66 and 67, and the outlet port 83 and 84 may vary in number and arrangement. In addition, it may be configured to omit the protruding part 65 and the nozzle 66 and 67 and spray water from the outlet port 83 and 84 into the drum 40. In addition, the nozzle 66 and 67 may be formed separately from the gasket 60 such that the nozzle 66 and 67 is coupled to the gasket or spaced apart from the gasket 60.

Referring to FIGS. 3 and 4, the washing machine according to an embodiment of the present invention includes the balancer 90 disposed at the front surface 31 of the tub 30. The balancer 90 may be fastened to the front surface 31 of the tub 30. The balancer 90 is a weight body having a predetermined weight to reduce vibration of the tub 30. The balancer 90 may include one or more balancers 90 disposed along a circumference of the front surface 31 of the tub 30.

The balancer 90 may include a first balancer 91 and a second balancer 92 respectively disposed on the left and right sides of the front surface 31 of the tub 30. The first balancer 91 may be disposed on the left side of the gasket 60, and the second balancer 92 may be disposed on the right side of the gasket 60.

A lower end portion of the first balancer 91 and a lower end portion of the second balancer 92 may be spaced apart from each other in a lower side of the gasket 60. An upper end portion of the first balancer 91 and an upper end portion of the second balancer 92 may be spaced apart from each other in an upper side of the gasket 60.

The respective lower end portions of the first and second balancers 91 and 92 may extend downward further than a lower portion of the front surface 31 of the tub 30. A connection tube 86*c* described in the following may have at least a portion disposed at a rear side further than the lower end portions of the balancers.

The first and second balancers 91 and 92 may be in a shape bilaterally symmetrical about the vertical line OV passing through the center of the gasket 60, and may be at positions bilaterally symmetrical about the vertical line OV.

Figure 13:
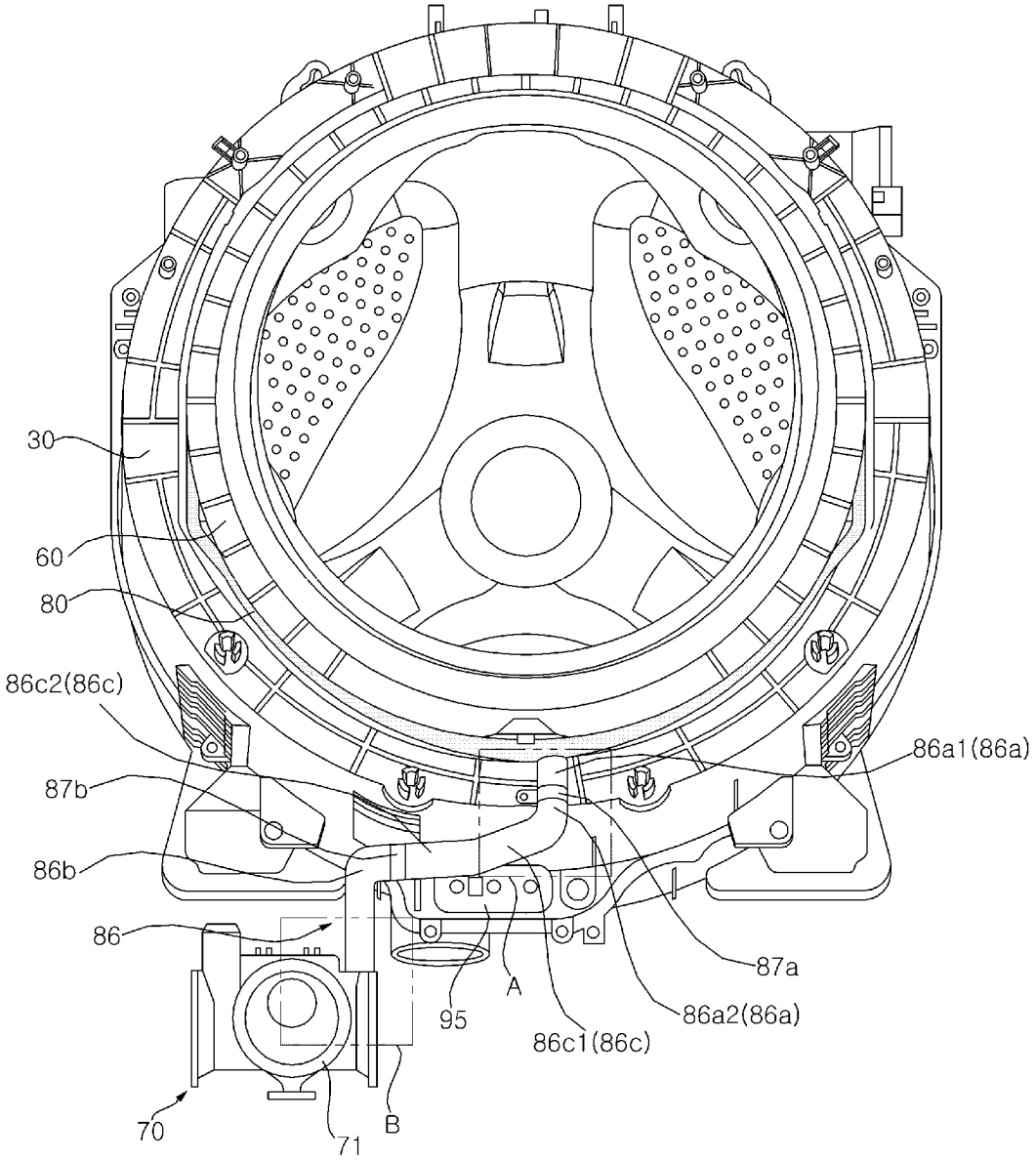
FIG. 13 is a front view of an assembly including a tub, a gasket, a distribution pipe, a circulation pipe, and a pump.
Figure 14:
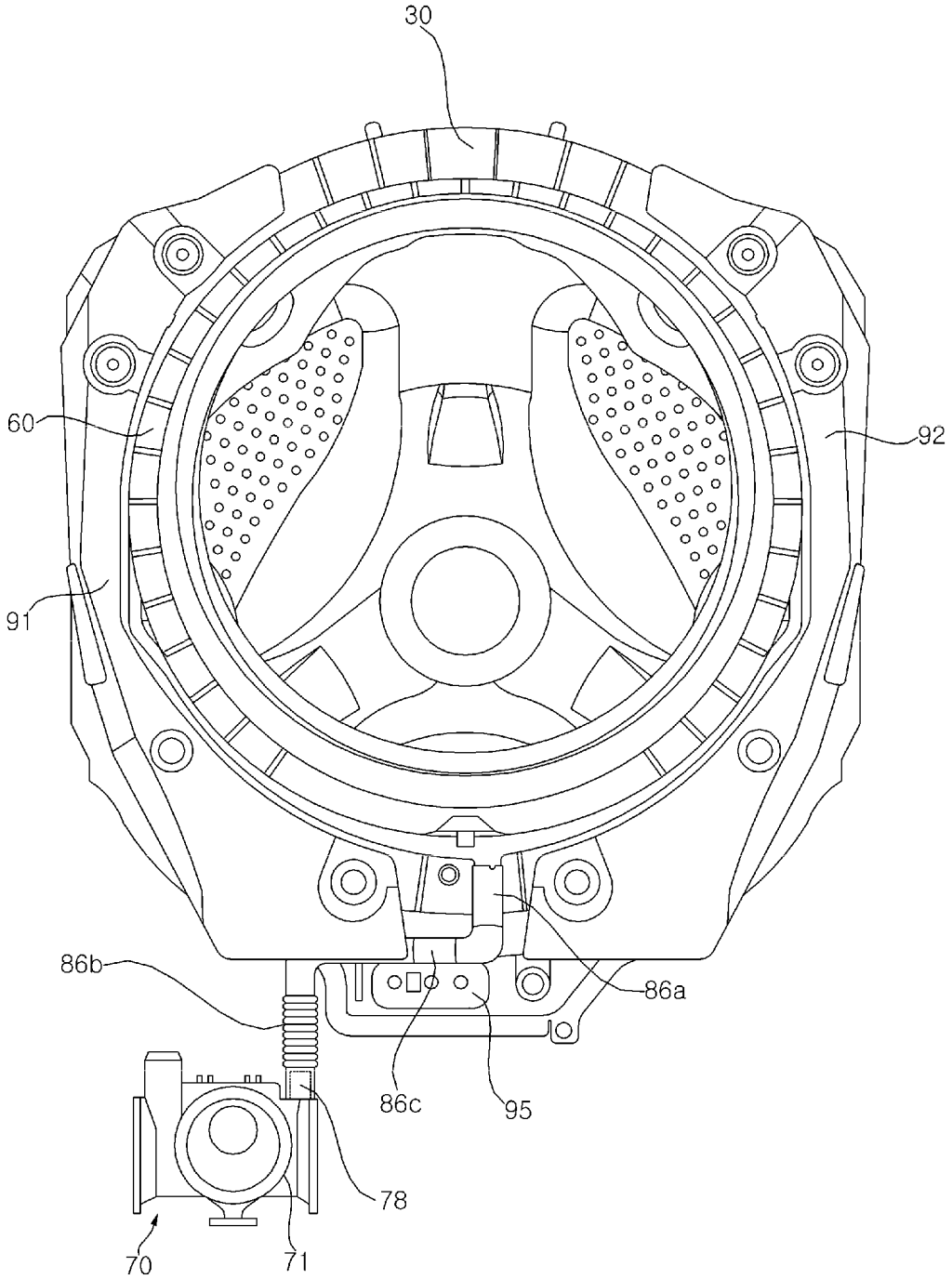
FIG. 14 is a front view of an assembly further including a balancer in addition to the configuration shown in FIG. 13.

Referring to FIGS. 13 and 14, the washing machine according to an embodiment of the present invention may include the heater 95 that heats water contained in the tub 30. The heater 95 may be installed below the tub 30. The heater 95 may be installed at a rear side further than the front surface 31 of the tub 30. Accordingly, the heater 95 may be spaced apart from the balancer 90 in a front-and-back direction. At least a portion of the connection pipe 86*c* may be disposed in front of the heater 95. That is, at least a portion of the connection pipe 86*c* may be disposed between the balancer 90 and the heater 95.

Figure 11:
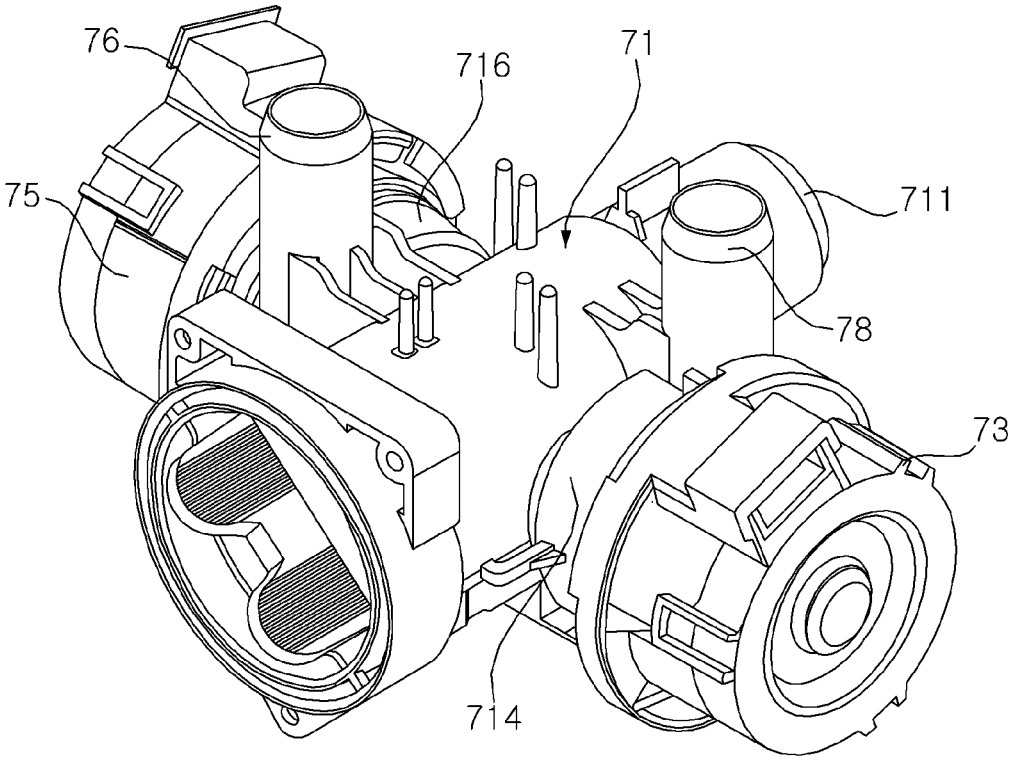
FIG. 11 is a perspective view of a pump shown in FIG. 4.
Figure 12A:
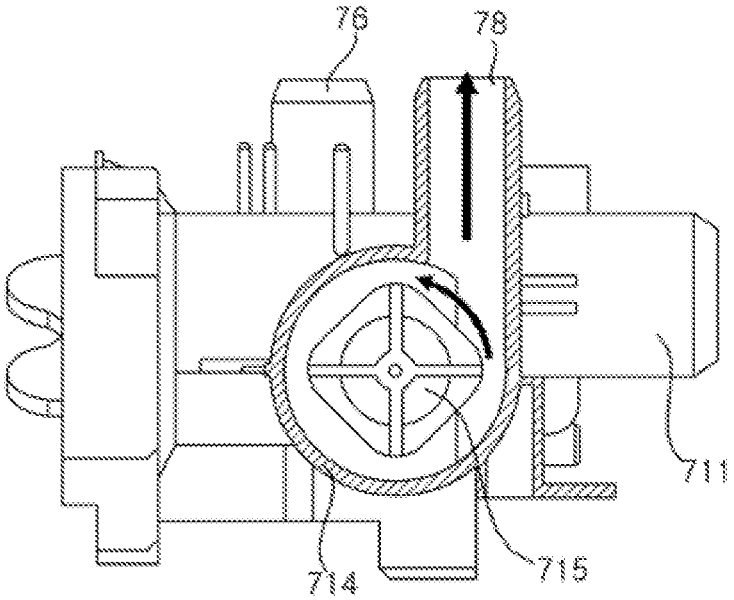
FIGS. 12A and 12B are cross-sectional views of a circulation chamber and a drain chamber in the pump shown in FIG. 4.
Figure 12B:
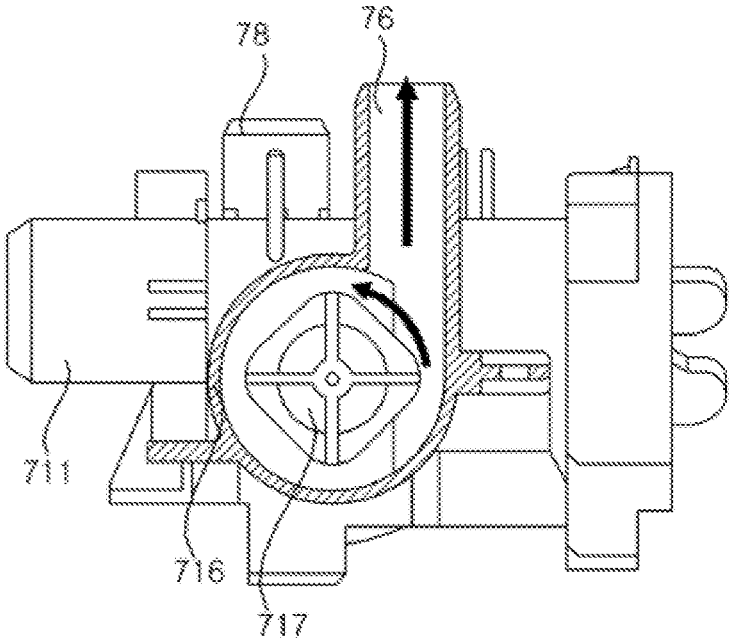

FIG. 11 is a perspective view of the pump 11. FIG. 12A is a cross-sectional view of a circulation chamber 714 (hereinafter, referred to as a "first chamber") seen from the right side of the pump 70. FIG. 12B is a cross-sectional view of a drain chamber 716 (hereinafter, referred to as a "second chamber") seen from the left side of the pump 70.

Referring to FIGS. 2, 11, and 12, the pump 70 may selectively perform a function of pumping water drained through the discharge hose 72 to the drain pipe 74, and a function of pumping water drained through the discharge hose 72 to the circulation pipe 86. The pump 70 may pump water discharged from the tub 30. As described above, water pumped by the pump 70, guided to the distribution pipe 70 along the circulation pipe 86, and sprayed into the drum 40 is referred to as circulating water.

The pump 70 may be disposed below the tub 30. The pump 70 may be disposed on any one of the left and right sides with respect to the center of the tub 30. More specifically, the pump 50 may be disposed on any one of the left and right sides with respect to the inlet port 85. In the drawings showing an embodiment of the present invention, an example in which the pump 70 is disposed on the left side with respect to the inlet port 85 is illustrated. However, the pump 70 may be disposed on the right side with respect to the inlet port 85.

The pump 70 may include a pump housing 71, a first pump motor 73, a first impeller 75, a second pump motor 75, and a second impeller 717. The pump 70 may include a circulation port 78 and a drain port 76, which protrude from the pump housing 71 and discharge water discharged from the tub 30.

A pump inlet port 711 may be formed in the pump housing 71. The pump housing 71 may include a first chamber 714 to house the first impeller 715, and a second chamber 716 to house the second impeller 717. The first impeller 715 is rotated by the first motor 73, and the second impeller 717 may be rotated by the second pump motor 75.

The first chamber 716 and the circulation port 78 form a flow path in a volute shape that is rolled in a direction of rotation of the first impeller 715. The second chamber 716 and the drain port 76 form a flow path in a volute shape that is rolled in a direction of rotation of the second impeller 716. Here, the direction of rotation of each impeller 715 and 717 is controllable and predetermined. The pump inlet port 711 is connected to the discharge hose 72, and the first chamber 714 and the second chamber 716 communicate with the pump inlet port 711. Water discharged from the tub 30 through the discharge hose 72 is supplied to the first chamber 714 and the second chamber 716 through the pump inlet port 711.

The first chamber 714 communicate with the circulation port 78, and the second chamber 716 communicate with the drain port 76. Accordingly, if the first impeller 715 is rotated upon operation of the first pump motor 73, water contained in the first chamber 714 is discharged through the circulation port 78. In addition, if the second pump motor 75 operates, the second impeller 717 is rotated, and, in turn, water contained in the second chamber 716 is discharged through the drain port 76. The circulation port 78 is connected to the circulation pipe 86, and the drain port 76 is connected to the drain pipe 74.

A an amount of water to be discharged from (or discharge pressure) of the pump 70 is variable. To this end, the pump motors 73 and 75 are speed-variable motors of which speeds or rotation is controllable. Each of the pump motors 73 and 75 is preferably, but not limited to, a Brushless Direct current Motor (BLDC). A driver for controlling speeds of the pump motors 73 and 75 may be further provided, and the driver may be an inverter driver. The inverter driver inverts AC power into DC power, and inputs the DC power to the motors at a target frequency.

A controller for controlling the pump motors 73 and 75 may be further provided. The controller may include a Proportional-Integral (PI) controller, a Proportional-Integral-Derivative (PID) controller), and the like. The controller may receive an output value (e.g., an output current) of a pump motor, and control an output value of the driver based on the received output value of the pump motor so that the number of times of rotation of the pump motor follows a preset target number of times of rotation.

The controller is capable of controlling not just speeds of rotation of the pump motors 73 and 75, but also directions of rotation thereof. In particular, an induction motor applied in a conventional pump is not capable of controlling a direction of rotation in a driving operation, and thus, it is difficult to control rotation of each impeller in a predetermined direction, as shown in FIGS. 12A and 12B, which causes a problem that the amount of water to be discharged from the drain or circulation port 76 or 78 differs depending on directions of rotation of the impellers. On the contrary, the present invention prevents such a problem because a direction of rotation in a driving operation of the pump motors 73 and 75 is controllable, and an amount of water to be discharged through the drain or circulation port 76 or 78 may be maintained at a constant level.

Meanwhile, the controller is capable of controlling not just the pump motors 73 and 75, but also overall operations of the washing machine. It is understood that each component described in the following is controlled by the controller.

Referring to FIGS. 13 and 14, the circulation pipe 76 connects the distribution pipe 80 and the pump 70, and guide water pumped by the pump 70 to the distribution pipe 60. One end portion 86*a*1 of the circulation pipe 86 is coupled to the inlet port 85. The other end portion of the circulation pipe 86, which is the opposite to one end portion 86*a*1 of the circulation pipe 86, is coupled to the circulation port 78 of the pump 70.

One end portion 86*a*1 of the circulation pipe 86 may have an inner diameter smaller than an outer diameter of the inlet port. The other end portion of the circulation pipe 86 may have an inner diameter smaller than an outer diameter of the circulation port 78. The circulation pipe 86 may be press-fitted into the inlet port 85 of the distribution pipe 80 and the circulation port 78 of the pump 70. Accordingly, it is possible to guide water pumped by the pump 70 to the distribution pipe 80 and prevent separation of the distribution pipe 80 from the pump 70.

If the circulation port 74 is disposed at a position to face the inlet port 81 along a straight line, the circulation pipe 86 may be in the shape of a straight pipe. Yet, the pump 70 and the circulation port 78 included in the washing machine according to an embodiment of the present invention are disposed on one of the left and right sides with reference to the inlet port 85.

In order to connect the inlet port 85 and the circulation port 78, connecting the inlet port 85 and the circulation port 78 in a straight line may be considered. However, if the circulation pump 86 is configured in a straight line shape to connect the inlet port 85 and the pump 70, this may cause intervention with the heater 95 installed below the tub 30 or with any other component.

For this reason, the circulation pipe 86 may be provided as a hose formed of a flexible substance and may be bent once or more. If the circulation pipe 86 is bent once or more, it is possible to efficiently utilize a space between the pump 70 and the distribution pipe 80.

The circulation pipe 86 may be formed of a substance that is flexible and capable of maintaining in shape. In the embodiment of the present invention, the circulation pipe 86 may be formed of Ethylene Propylene Diene Monomer (EPDM) rubber.

As described above, the inlet port 84 of the distribution pipe 80 and the circulation port 78 of the pump are not aligned on a straight line, and the circulation pipe 86 is formed of a flexible substance capable of maintaining in shape. If the circulation pipe 80 moves out of the right position, a portion of the circulation pipe 80 may be bent. As a result, a flow path in the circulation pipe 80 may be narrowed or blocked.

In the case where the flow path in the circulation pipe 86 is narrowed or blocked, it is not possible to supply a sufficient amount of circulating water to the plurality of nozzles 66 and 67 even though the pump 70 operates normally. Further, the circulation pipe 86 may be separated or damaged by consistent use of the washing machine In order to solve the problem, the inlet port may include a positioning mean that guides the right position of the circulation pipe. On the contrary, to solve the problem, the circulation pipe may include a corrugated tube portion 86*b*2. Further, the inlet port 85 may include the positioning mean and the circulation pipe 86 may include the corrugated tube portion 86*b*2.

Figure 16:
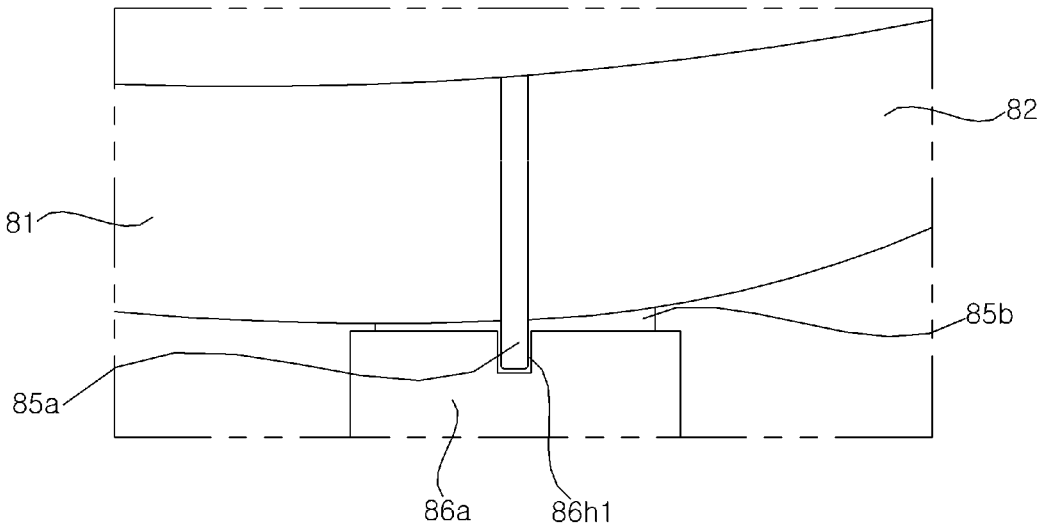
FIG. 16 is an enlarged view of area A shown in FIG. 13.

Referring to FIG. 16, the inlet port 85 includes an inlet pipe 85*b* coupled to the circulation pipe 86, and a first positioning protrusion 85*a* protruding from an outer circumferential surface of the inlet pipe 85*b*. The inlet port 85 may be coupled to the circulation pipe 86 as the inlet pipe 85*b* is inserted into one end portion 86*a*1 of the circulation pipe. At one end portion 86*a*1 of the circulation pipe, a first positioning groove into which the first positioning protrusion 85*a* is inserted is formed.

Thus, when the distribution pipe 80 and the circulation pipe 86 are assembled, the right position of the circulation pipe 86 may be guided. In addition, the circulation pipe 86 may remain in the right position even though the tub 30 vibrates in the use of the washing machine.

Not just the inlet port 85 but also the circulation port 78 mat include a positioning means for guiding the right position of the circulation pipe 86. The circulation port 78 may include a tube portion inserted into the circulation pipe 86, and a second positioning protrusion 78*a* protruding from an outer circumferential surface of the tube portion. The circulation port 78 may be inserted into the other end portion 86*b*1 of the circulation pipe, which corresponds to the opposite to one end portion 86*a*1, to be thereby coupled to the circulation pipe 86. In the other end portion 86*b*1 of the circulation pipe, a second positioning groove into which the second positioning protrusion 78*a* is inserted may be formed.

Figure 15:
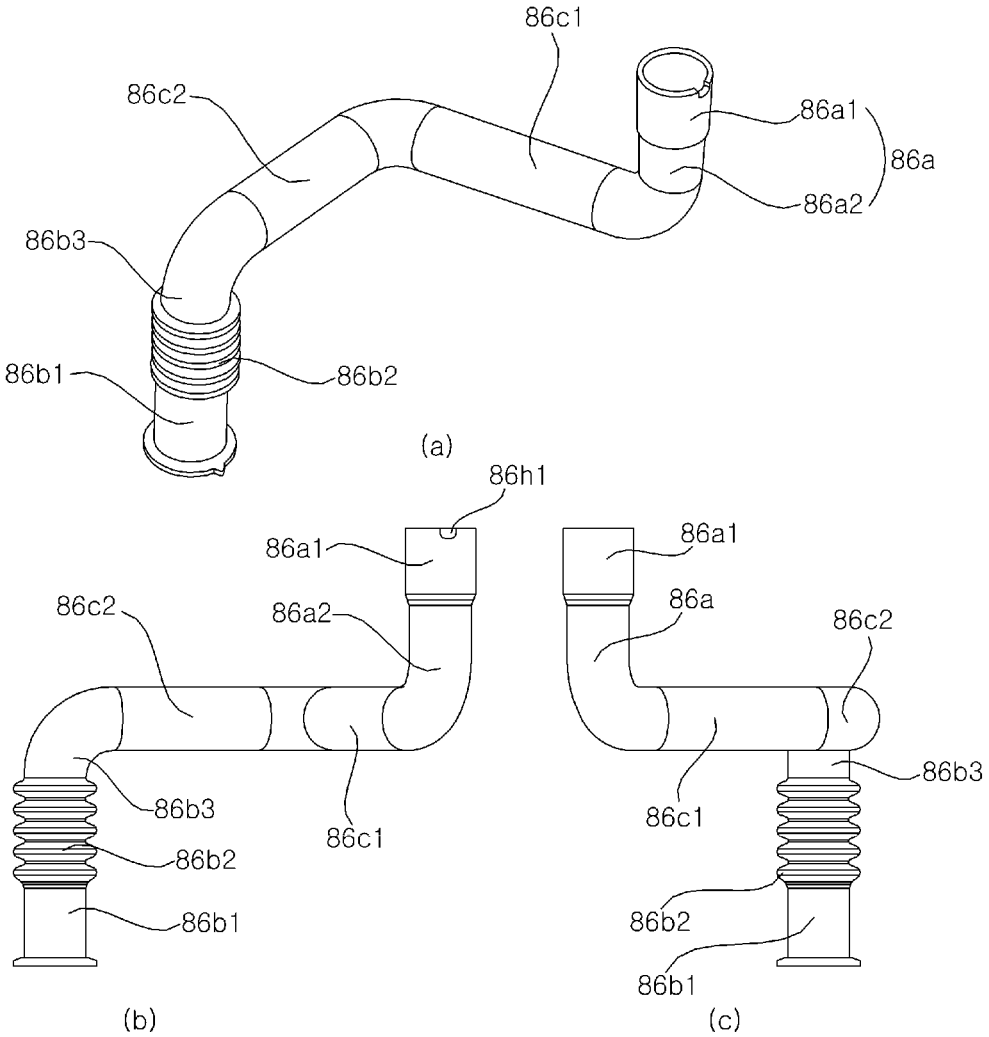
FIG. 15 is a diagram illustrating a circulation pipe shown in FIG. 4.

Referring to FIG. 15, the circulation pipe 86 may include a first port coupling tube 86*a* coupled to the inlet port 85 of the distribution pipe 80, a second port coupling tube 86*b* coupled to the circulation port 78 of the pump 70, and a connection tube 86*c* connecting the first port coupling tube 86*a* and the second port coupling tube 86*b*.

The first port coupling tube 86*a* may include a first coupling portion 86*a*1 coupled to the inlet port 85, and a first coupling tube portion 86*a*2 extending downward from the first coupling portion 86*a*1. The inlet port 85 may be inserted into the first coupling portion 86*a*1. One end portion 86*a*1 of the circulation pipe described above refers to the first coupling portion 86*a*1. The first coupling tube portion 86*a*2 may vertically extend downward from the first coupling portion 86*a*1.

The first coupling portion 86*a*1 may have a diameter greater than a diameter of the first coupling tube portion 86*a*2. Accordingly, the distribution pipe 80 and the circulation pipe 86 may be inserted in a manner in which an upper end portion of the circulation pipe 86 is inserted up to a point where the upper end portion can meet a lower end portion of the transport conduit 81 and 82 or in a manner in which a lower end portion of the inlet port 85 is inserted up to a point where the lower end portion can meet the first coupling tube portion 86*a*2.

On both sides of the first port coupling tube 86*a* and the inlet port 85, the first and second balancers 91 and 92 are spaced apart each other. In a lower side of the space between the two balancers 91 and 92, the port coupling tube 86*a* and the inlet port 85 may be installed. The inlet port 85 is preferably formed vertically to avoid interference with the balancer 90. Likewise, the first port coupling tube 86*a* coupled to the inlet port 85 is preferably formed vertically as well.

The connection tube 86*c* may connect the first port coupling tube 86*a* and the second port coupling tube 86*b*, and at least a portion of the connection tube 86*c* may be disposed between the heater 95 and the balancer 90. The connection tube 86*c* may be bent from the lower end of the first coupling tube portion 86*a*2 and extend toward one side in which the tub 70 is disposed. The connection tube 86*c* may extend toward the second port coupling tube 86*b*.

The connection tube 86*c* may include a first connection tube 86*c*1 bent from the first coupling tube portion 86*a*2 and extending in a direction in which the heater 95 is disposed, and a second connection tube 86*c*2 bent from the first connection tube 86*c*1 and extending toward one side in which the pump 70 is disposed.

The first connection tube 86*c*1 may be bent from the first coupling tube portion 86*a*1 and extend to the rear. Here, the term "rear" means not just a rear side in the front-rear direction, but also a state rearwardly biased to one side of the left and right sides.

The first connection tube 86*c* may be bent at 90° from a lower side of the first coupling tube portion 86*a*2. However, the bending angle is not necessarily limited to 90°.

The second connection tube 86*c*2 may be bent from an end portion of the rear side of the first connection tube 86*c*1 and extend toward one side of the left and right sides, where the pump 70 is disposed, with reference to the inlet port 85. For example, if the pump 70 is disposed close to the left side of the tub 30 (or the inlet port 85), the second connection tube 86*c*2 may be bent to the left from the first connection tube 86*c*1. If the pump 70 is disposed close to the right side from the tube 30 (or the inlet port 85), the second connection tube 86*c*2 may be bent to the right from the first connection tube 86*c*1.

In front of the second connection tube 86*c*2, one of the first and second balancers, which is disposed in one side in which the pump 70 is disposed, may be positioned. For example, as shown in FIG. 14, if the pump 70 is disposed on the left side and the first balancer is disposed on the left side of the gasket, the second connection tube is disposed at a rear side of the first balancer.

The second connection tube 86*c*2 may be disposed at a front side of the heater 95.

The second connection tube 86*c*2 may extend from the first connection tube 86*c*1 to a vertical upper side of the circulation port 78.

Since the pump 70 is disposed below the tub 30, the circulation port 78 is preferably formed vertically upward from the pump housing 71. In addition, since the circulation port 78 is formed vertically upward, the second port coupling tube 86*b* is preferably formed vertically as well.

The second port coupling tube 86*b* may include a second coupling portion 86*b*1 into which the circulation port is inserted, and a corrugated tube portion 86*b*2 extending from the second coupling portion 86*b*1 toward a second connection tube 86*c*2. The other end portion 86*b*1 of the circulation pipe described above refers to the second coupling portion 86*b*1.

The corrugated tube portion 86*b*2 may be connected directly to the second connection tube portion 86*b*2, or the second port coupling tube 86*b* may include a bent tube portion 86*b*3 bent from the second connection tube 86*c*2 in a direction parallel to the second coupling portion 86*b*1, and the corrugated tube portion 86*b*2 may connect the second coupling portion 86*b*1 and the bent tube portion 86*b*3.

The corrugated tube portion 86*b*2 may be flexible relatively compared to the first port coupling tube 86*a*, the connection tube 86*c*, the second coupling portion 86*b*1, and the bent tube portion 86*b*3.

The second port coupling tube 86*b* is a portion adjacent to the tube 70 and may be most greatly affected by vibration occurring in driving of the pump 70. As the second port coupling tube 86*b* includes the corrugated tube portion 86*b*2, the second port coupling tube 86*b* may prevent delivery of the vibration of the pump 70 to the distribution pipe 80 and delivery of the vibration of the tub 30 to the pump.

Therefore, it is possible to prevent damage to the circulation pipe 86 in advance and reduce noise caused by vibration.

A bending angle of the bent tube portion 86*b*3 may be, but not limited to, 90°.

The first connection tube 86*c*1 and the second connection tube 86*c*2 may be disposed on the same plane, and the same plane may be a horizontal surface (a surface parallel to the bottom surface of the washing machine). The first port coupling tube 86*a* and the second port coupling tube 86*b* may be disposed to be vertical to the horizontal plane. The port coupling tube 86*a* may be disposed on the upper side of the horizontal surface, and the second port coupling tube 86*b* may be disposed on the lower side of the horizontal surface.

The first and second port coupling tubes 86*a* and 86*b* and the first and second connection tubes 86*c*1 and 86*c*2 may be formed separately and coupled or may be formed integrally.

The circulation pipe 86 may be fixed to the tub 30 by a clamp 87. The clamp 87 may fix the circulation pipe 86 to the tub 30, thereby preventing separation, deformation, and distortion of the circulation pipe 86 upon a supply of circulating water. The clamp 87 may include a first clamp 87*a* coupled to the front surface of the tub 30, and a second clamp 87*b* coupled to the bottom surface of the tub 30.

The first clamp 87*a* may be formed to be longer than a circumference of the first port coupling tube 86*a*. The first clamp 87*a* may be disposed to surround the circumference of the first port coupling tube 86*a*, and then the remaining part of the first clamp 87*a* after surrounding the circumference of the first port coupling tube 86*a* may be screw-connected to the tub 30 to fix a connecting tube portion 86*b* to the lower surface of the tub 30.

Figure 17:
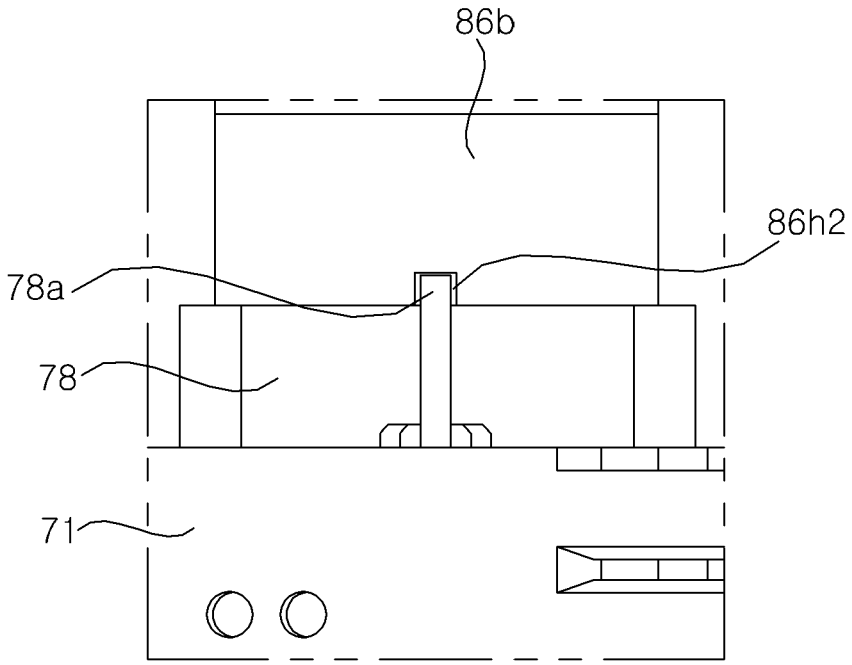
FIG. 17 is an enlarged view of area B shown in FIG. 13.

Referring to FIGS. 16 and 17, the circulation pipe 86 is coupled to the distribution pipe 80. The positioning protrusion 85*a* and the positioning groove 86*h*1 are formed in the distribution pipe 80 and the circulation pipe 86 to be engaged with each other. The inlet port 85 of the distribution pipe 80 includes the first positioning protrusion 85*a*, and the first positioning groove 86*h*1 is formed in the first coupling portion 86*a*1 of the first port coupling tube 86*a*. The circulation pipe 86 may be coupled to the inlet port 85 so that the first positioning protrusion 85*a* is inserted into the first positioning groove 86*h*1.

The first positioning protrusion 85*a* protrudes from the outer circumferential surface of the inlet pipe 85*b* of the inlet port 85. The first positioning protrusion 85*a* may extend to at least a lower side of the transport conduit 81 and 82. That is, the first positioning protrusion 85*a* may extend to the upper end portion of the inlet pipe 85*b*.

Meanwhile, the distribution pipe 80 may be fabricated by press-fitting a molten raw material of the transport conduit 81 and 82 in a state in which the pre-prepared outlet port 83 and 84 and the inlet port 85 are inserted into a mold. In this fabricating process, a diameter of the inlet port 85 may be smaller than a front-rear width of a portion at which the inlet port 83 protrudes from the transport conduit 81 and 82. As a result, a step may be formed between the transport conduit 81 and 82 and the inlet port 85.

The inlet port 85 may be disposed in the lower side of the transport conduit 81 and 82 and disposed at the center in the front-rear direction of the transport conduit 81 and 82. The first positioning protrusion 85*a* may protrude from the outer circumferential surface of the inlet pipe 85*b* and may protrude by half a difference between the rear-front width of the transport conduit 81 and 82 and the diameter of the inlet pipe 85*b*. That is, the first positioning protrusion 85*a* may protrude to a height corresponding to a height of the step formed between the transport conduit 81 and 82 and the inlet pipe 85*b*.

Alternatively, as shown in FIG. 16, the first positioning protrusion 85*a* may have a height greater than the height of the step formed between the transport conduit 81 and 82 and the inlet pipe 85*b*. In this case, the first positioning protrusion 85*a* may further protrude from one surface of the transport conduit 81 and 82. The first positioning protrusion 85*a* may protrude from the outer circumferential surface of the inlet pipe 85*b*. The first positioning protrusion 85*a* may extend to at least a lower end portion of the transport conduit 81 and 82, which meets the inlet port 85, and may extend in a straight line to an upper end portion of the transport conduit 81 and 82 where the inlet port 85 is disposed.

The first positioning protrusion 85*a* is configured to guide the right position of the circulation pipe 86 and the distribution pipe 80 to assemble, and the first positioning protrusion 85*a* is provided with a width and a length sufficient to easily assemble the circulation pipe 86 and the distribution pipe 80 in the right position. The sufficient width and length may indicate a size that allows an assembling person to notice the positions of the first positioning protrusion 85*a* and the first positioning groove 86*h*1 at a glance to thereby engage the first positioning protrusion 85*a* and the first positioning groove 86*h*1. For example, the first positioning protrusion 85*a* may have a length equal to or greater than 1 mm or equal to or smaller than 10 mm from the lower end portion of the transport conduit 81 and 82, and may have a width equal to or greater than 1 mm or equal to or smaller than 10 mm along the outer circumferential surface of the inlet pipe 85*b*. In addition, the length and width of the first positioning protrusion 85*a* may have a size relative to inlet port 85 and the circulation pipe 86.

A first guide protrusion 85*a* may be formed at the front side of the outer circumferential surface of the inlet pipe 85*b*. That is, the first positioning protrusion 85*a* may be formed in the front side of the distribution pipe 80. Accordingly, even when the distribution pipe 80 is assembled to the gasket 60, it is possible to easily figure out the position of the first positioning protrusion 85*a* and easily assemble the circulation pipe 86 at the right position.

The first positioning groove 86*h*1 may be formed in the first coupling portion 86*a*1 and in a shape corresponding to the first positioning protrusion 85*a*. The first positioning groove 86*h*1 may be in a shape corresponding a portion of the first positioning protrusion 85*a* which extends downward from the lower end portion of the transport conduit 81 and 82. That is, the first positioning groove 86*h*1 may be formed to have the same width and the same length of the first positioning protrusion 85*a*. Alternatively, the first positioning groove 86*h*1 may have a width and a size a bit greater than those of the first positioning protrusion 85*a*, so that the first positioning groove 86*h*1 and the first positioning protrusion 85*a* are engaged easily.

The first positioning groove 86*h*1 may be formed on the front side of the first coupling portion 86*a*1 to correspond to the first positioning protrusion 85*a*. The first positioning groove 86*h*1 may be formed to allow the inner surface and the outer surface of the first coupling portion 86*a*1 to pass therethrough. For example, the first positioning groove 86*h* may be formed by punching at an end of the first coupling portion 86*a*1.

Similarly to the first positioning protrusion 85*a* and the first positioning grove 86*h*1, the circulation port 78 may include a second positioning protrusion 78*a*, and a second positioning groove 86*h*2 may be formed in the second coupling portion 86*b*1 of the circulation pipe 86. The circulation pipe 86 may be coupled to the circulation port 78 so that the second positioning protrusion 78*a* and the second positioning groove 86*h*2 are engaged with each other.

Meanwhile, the circulation port 78 may have a tube portion hook portion protruding from the first chamber 714 and inserted into the circulation pipe 86, and a hook portion disposed below the tube portion. The tube portion may have an outer diameter equal to or a bit greater than an inner diameter of the second coupling portion 86*b*1 to be thereby press-fitted into the circulation pipe 86, and an end portion of the circulation pipe 86 may be coupled up to a point where to the end portion can meet the hook portion.

The second positioning protrusion 78*a* protrudes from the outer circumferential surface of the circulation port 78. The circulation port 78 may protrude from the pump housing 71, and the second positioning protrusion 78*a* may extend to a point where the circulation port 78 and the first chamber 714 meets each other.

More specifically, the second positioning protrusion 78*a* may protrude from the outer circumferential surface of the tube portion of the circulation port 78, and partially extend at least to a point where the tube portion meets the hook portion. The second positioning protrusion 78*a* may protrude from the outer circumferential surface of the tube portion of the circulation port 78 to extend to a point where the hook portion and the first chamber 714 meets.

The second positioning groove 86*h*2 may be in a shape corresponding to a portion of the second positioning protrusion 78*a* which protrudes from the coupling portion of the circulation port 78.

The second positioning groove 86*h*2 may be formed with the same width and the same length of the second positioning protrusion 78*a*. Alternatively, the second positioning groove 86*h*2 may be formed with a length and a width that are slightly greater than a length and a width of the second positioning protrusion 78*a* so that the second positioning protrusion 78*a* and the second positioning groove 86*h*2 are easily engaged in an assembling process.

Unmentioned configurations about the second positioning protrusion 78*a* and the second positioning groove 86*h*2 may be identical or similar to configurations of the first positioning protrusion 85*a* and the first positioning groove 86*h*1, respectively.

Although some embodiments have been described above, it should be understood that the present invention is not limited to these embodiments, and that various modifications, changes, alterations and variations can be made by those skilled in the art without departing from the spirit and scope of the invention. Therefore, it should be understood that the above embodiments are provided for illustration only and are not to be construed in any way as limiting the present invention.

What is claimed is:

1. A washing machine comprising:

a casing that defines a laundry entry hole at a front surface of the casing;

a tub disposed in the casing, the tub defining a tub opening at a front surface of the tub;

a drum rotatably disposed in the tub;

a gasket that has a cylindrical shape and defines a passage connecting the laundry entry hole to the tub opening;

a plurality of nozzles disposed at the gasket and configured to spray water into the drum;

a pump disposed below the tub and configured to pump water discharged from the tub;

a distribution pipe connected to the plurality of nozzles, the distribution pipe comprising:

a transport conduit that extends along the gasket and is connected to the plurality of nozzles, and an inlet port that protrudes from a lower portion of the transport conduit;

a circulation pipe that connects the inlet port and the pump;

a first balancer disposed on the front surface of the tub and positioned at a left side of the gasket; and a second balancer disposed on the front surface of the tub and positioned at a right side of the gasket, wherein a lower end portion of the first balancer and a lower end portion of the second balancer are disposed at a lower portion of the gasket and spaced apart from each other, and wherein the inlet port is disposed in a space defined between the lower end portion of the first balancer and the lower end portion of the second balancer.

2. The washing machine of claim 1, wherein the inlet port comprises:

an inlet pipe inserted into the circulation pipe; and a first positioning protrusion that protrudes from a front surface of the inlet pipe, wherein the circulation pipe has a first end portion coupled to the inlet port, the first end portion defining a first positioning groove, wherein the first positioning protrusion is inserted into the first positioning groove, and wherein the pump comprises a circulation port coupled to the circulation pipe.

3. The washing machine of claim 2, wherein the circulation port comprises a tube portion inserted into the circulation pipe and a second positioning protrusion that protrudes from an outer circumferential surface of the tube portion, and wherein the circulation pipe defines a second positioning groove that has a shape corresponding to the second positioning protrusion, that is configured to receive the second positioning protrusion, and that is disposed at a second end of the circulation pipe coupled to the circulation port.

4. The washing machine of claim 2, wherein the circulation pipe comprises:

a first port coupling tube comprising a first coupling portion coupled to the inlet port and a first coupling tube portion that extends downward from the first coupling portion;

a connection tube that is bent from the first coupling tube portion and that extends toward one of the left side of the inlet port or the right side of the inlet port, the pump being disposed at a side of the gasket corresponding to the one of the left side of the inlet port or the right side of the inlet port; and a second port coupling tube that connects the connection tube to the circulation port.

5. The washing machine of claim 4, wherein the second port coupling tube comprises:

a second coupling portion configured to receive the circulation port; and a corrugated tube portion that extends from the second coupling portion toward the connection tube, and wherein a flexibility of the corrugated tube portion is greater than a flexibility of each of the first port coupling tube, the connection tube, and the second coupling portion.

6. The washing machine of claim 5, wherein the second port coupling tube comprises a bent tube portion that is bent from the connection tube in a direction parallel to the second coupling portion, and wherein the corrugated tube portion connects the bent tube portion to the second coupling portion.

7. The washing machine of claim 4, wherein the connection tube comprises:

a first connection tube that is bent from the first coupling portion and that extends rearward; and a second connection tube that is bent from the first connection tube and that extends toward the side of the gasket at which the pump is disposed.

8. The washing machine of claim 7, wherein the second port coupling tube comprises:

a bent tube portion that is bent downward from the second connection tube; and a second coupling portion that is configured to extend from the bent tube portion and to receive the circulation port.

9. The washing machine of claim 4, further comprising a clamp configured to fix the circulation pipe to the tub.

10. The washing machine of claim 9, wherein the clamp comprises:

a first clamp configured to fix the first port coupling tube to the front surface of the tub; and a second clamp configured to fix the connection tube to a lower surface of the tub.

11. The washing machine of claim 4, wherein the connection tube is disposed on a horizontal plane, and wherein the first port coupling tube and the second port coupling tube extend in a direction orthogonal to the horizontal plane.

12. The washing machine of claim 1, wherein the lower end portion of the first balancer and the lower end portion of the second balancer are disposed below a lowermost portion of the gasket, wherein the circulation pipe comprises a first port coupling tube coupled to the inlet port, and wherein the first port coupling tube is disposed in the space defined between the lower end portion of the first balancer and the lower end portion of the second balancer.

13. The washing machine of claim 12, further comprising a heater disposed vertically below the tub at a rear side of the front surface of the tub, the heater being configured to heat water received in the tub, wherein the lower end portion of the first balancer and the lower end portion of the second balancer extend to a lower side than a lower end portion of the front surface of the tub, wherein the circulation pipe further comprises a connection tube that is bent from the first port coupling tube, and wherein at least a portion of the connection tube is disposed between the heater and one of the first balancer or the second balancer that is disposed at a side of the gasket at which the pump is disposed.

14. The washing machine of claim 13, wherein the connection tube comprises:

a first connection tube that is bent from the first port coupling tube and that extends in a direction toward the heater; and a second connection tube that is bent from the first connection tube and that extends toward the side of the gasket at which the pump is disposed, wherein the second connection tube is disposed rearward of the one of the first balancer or the second balancer, and wherein the second connection tube is disposed forward of the heater.

15. The washing machine of claim 12, wherein the distribution pipe comprises:

a left conduit that extends along the gasket to the left side of the inlet port and is disposed between the first balancer and the gasket; and a right conduit that extends along the gasket to the right side of the inlet port and is disposed between the second balancer and the gasket.

16. The washing machine of claim 1, wherein the transport conduit extends along the gasket to the left side of the inlet port and the right side of the inlet port, and wherein the inlet port protrudes downward from the transport conduit.

17. The washing machine of claim 16, wherein the inlet port comprises:

an inlet pipe inserted into the circulation pipe; and a first positioning protrusion that protrudes from a front surface of the inlet pipe, wherein the circulation pipe has a first end portion coupled to the inlet port, the first end portion defining a first positioning groove, wherein the first positioning protrusion is inserted into the first positioning groove, and wherein the first positioning protrusion extends downward from an upper end of the inlet pipe.

18. The washing machine of claim 16, wherein the distribution pipe further comprises:

a plurality of outlet ports that protrude from the transport conduit toward the gasket and that are configured to supply water to the plurality of nozzles, and wherein the inlet port is disposed at a position lower than the plurality of the outlet ports.

19. The washing machine of claim 1, wherein the pump is disposed at one of a left side of the inlet port or a right side of the inlet port.

20. The washing machine of claim 1, wherein the inlet port comprises:

an inlet pipe inserted into the circulation pipe; and a first positioning protrusion that protrudes from a front surface of the inlet pipe, wherein the circulation pipe has a first end portion coupled to the inlet port, the first end portion defining a first positioning groove, and wherein the first positioning protrusion is inserted into the first positioning groove.

21. The washing machine of claim 20, wherein a width of the first positioning groove in a circumferential direction of the circulation pipe is uniform from the first end portion of the circulation pipe to an inner portion of the first positioning groove that faces a distal end of the first positioning protrusion.

22. The washing machine of claim 1, wherein the lower end portion of the first balancer and the lower end portion of the second balancer are disposed below a lowermost portion of the gasket.

23. The washing machine of claim 22, wherein the inlet port is disposed between the lower end portion of the first balancer and the lower end portion of the second balancer in a left-right direction.

* * * * *